US008899335B2

(12) United States Patent
Churchill

(10) Patent No.: US 8,899,335 B2
(45) Date of Patent: Dec. 2, 2014

(54) DOWNHOLE TOOL

(75) Inventor: Andrew Churchill, Aberdeen (GB)

(73) Assignee: Churchill Drilling Tools Limited (GB)

( * ) Notice: Subject to any disclaimer, the term of this patent is extended or adjusted under 35 U.S.C. 154(b) by 290 days.

(21) Appl. No.: 13/319,266

(22) PCT Filed: May 7, 2010

(86) PCT No.: PCT/GB2010/000899
§ 371 (c)(1),
(2), (4) Date: Dec. 8, 2011

(87) PCT Pub. No.: WO2010/128291
PCT Pub. Date: Nov. 11, 2010

(65) Prior Publication Data

US 2012/0111576 A1 May 10, 2012

(30) Foreign Application Priority Data

May 7, 2009 (GB) ..... 0907786.8
May 21, 2009 (GB) ..... 0908796.6
Jun. 23, 2009 (GB) ..... 0910815.0

(51) Int. Cl.
*E21B 34/14* (2006.01)
*E21B 21/10* (2006.01)
*E21B 23/00* (2006.01)

(52) U.S. Cl.
CPC ..... *E21B 21/103* (2013.01); *E21B 23/00* (2013.01)
USPC ..... 166/373; 166/386; 166/332.4; 166/334.3; 166/334.4; 175/317

(58) Field of Classification Search
CPC ..... E21B 21/103; E21B 34/14; E21B 34/06; E21B 2034/007
USPC ..... 166/373, 386, 318, 332.4, 334.1, 334.3, 166/334.4; 175/317
See application file for complete search history.

(56) References Cited

U.S. PATENT DOCUMENTS 2,307,983 A * 1/1943 Barnes ..... 166/135
4,427,070 A 1/1984 O'Brien (Continued)

FOREIGN PATENT DOCUMENTS

GB 2268770 A 1/1994
WO 0214650 A1 2/2002

(Continued)

OTHER PUBLICATIONS

International Search Report—International application No. PCT/GB2010/000899.

(Continued)

*Primary Examiner* — Jennifer H Gay
(74) *Attorney, Agent, or Firm* — Gifford, Krass, Sprinkle, Anderson & Citkowski, P.C.

(57) ABSTRACT

A downhole bypass valve comprises a tubular body including a side port and a sleeve axially movably mounted in the body and normally biased to a closed position to close the side port. An activating device is configured to be pumped or dropped into the body to engage the sleeve and permit movement of the sleeve to an open position and open the side port. A latch has a part in the body and a part in the activating device, the parts of the latch configured to engage and retain the sleeve in the open position. The activating device is further operable to disengage from and translate through the sleeve and the parts of the latch are further operable to disengage and permit the sleeve to return to the closed position.

20 Claims, 10 Drawing Sheets

(56) References Cited

U.S. PATENT DOCUMENTS

| | | | | |
|---|---|---|---|---|
| 5,174,379 | A * | 12/1992 | Whiteley et al. | 166/278 |
| 5,499,687 | A | 3/1996 | Lee | |
| 6,820,697 | B1 * | 11/2004 | Churchill | 166/374 |
| 6,923,255 | B2 * | 8/2005 | Lee | 166/154 |
| 6,973,966 | B2 * | 12/2005 | Szarka | 166/153 |
| 7,347,288 | B2 * | 3/2008 | Lee | 175/317 |
| 7,347,289 | B2 * | 3/2008 | Lee | 175/317 |
| 7,520,336 | B2 * | 4/2009 | Mondelli et al. | 166/386 |
| 7,640,983 | B2 * | 1/2010 | Hilleary et al. | 166/287 |
| 7,665,545 | B2 * | 2/2010 | Telfer | 175/57 |
| 7,766,084 | B2 * | 8/2010 | Churchill | 166/320 |
| 8,550,176 | B2 * | 10/2013 | Knobloch et al. | 166/386 |
| 2002/0074128 | A1 | 6/2002 | Allamon et al. | |
| 2004/0011566 | A1 * | 1/2004 | Lee | 175/317 |
| 2005/0072572 | A1 * | 4/2005 | Churchill | 166/319 |
| 2005/0103504 | A1 * | 5/2005 | Szarka | 166/386 |
| 2005/0133217 | A1 | 6/2005 | Erkol | |
| 2006/0108152 | A1 * | 5/2006 | Lee | 175/317 |
| 2006/0124310 | A1 * | 6/2006 | Lopez de Cardenas et al. | 166/313 |
| 2007/0181313 | A1 * | 8/2007 | Churchill | 166/374 |
| 2008/0093080 | A1 | 4/2008 | Palmer et al. | |
| 2008/0169108 | A1 * | 7/2008 | Mondelli et al. | 166/386 |
| 2009/0025930 | A1 | 1/2009 | Iblings et al. | |
| 2009/0056952 | A1 * | 3/2009 | Churchill | 166/373 |
| 2009/0084555 | A1 | 4/2009 | Lee | |
| 2011/0203809 | A1 * | 8/2011 | Knobloch et al. | 166/386 |
| 2011/0284240 | A1 * | 11/2011 | Chen et al. | 166/373 |
| 2012/0073828 | A1 * | 3/2012 | Churchill | 166/373 |
| 2012/0111576 | A1 * | 5/2012 | Churchill | 166/373 |
| 2012/0125629 | A1 * | 5/2012 | Churchill | 166/373 |

FOREIGN PATENT DOCUMENTS

| | | | |
|---|---|---|---|
| WO | 03/087526 | A1 | 10/2003 |
| WO | 2007/060449 | A2 | 5/2007 |
| WO | 2008/146012 | A2 | 4/2008 |
| WO | 2008/142409 | A1 | 11/2008 |

OTHER PUBLICATIONS

International Search Report—International application PCT/GB2010/000895.

International Search Report—International application No. PCT/GB2010/000901.

European Search Report—Application No. 10 719 770.9.

European Search Report—Application No. 10 720 801.9.

* cited by examiner

DOWNHOLE TOOL

CROSS-REFERENCE TO RELATED APPLICATIONS

This application is the U.S. National Phase of PCT/GB2010/000899 filed May 7, 2010, which claims priority of Great Britain Patent Applications 0907786.8 filed May 7, 2009; 0908796.6 filed May 21, 2009; and 0910815.0 filed Jun. 23, 2009.

FIELD OF THE INVENTION

This invention relates to a downhole tool and to a method of using or operating the tool. The invention has particular application in bypass tools and methods of operating such tools.

BACKGROUND OF THE INVENTION

Bypass valves may be provided in drill strings to provide a flow path between the drill string bore and the annulus without the requirement for fluid to pass through elements of the bottom hole assembly (BHA). This may be useful for a number of reasons. When it is considered appropriate or necessary to deliver lost circulation material (LCM) to the annulus, it is preferred that measurement-while-drilling (MWD) tools and the jetting nozzles in the drill bit are isolated from the LCM, which might otherwise cause damage or blockage. Thus, a bypass valve may be provided above the MWD tool. Furthermore, for hole cleaning it may be desirable to achieve a higher circulation rate of fluid in the annulus above the valve, and this is more readily obtained if the circulating fluid can bypass the drill string and MWD below the bypass valve which would otherwise consume pressure and thus hydraulic power.

SUMMARY OF THE INVENTION

According to an aspect of the invention there is provided an activating device for location in downhole tubing, the device having an activation profile configurable to be maintained at a larger diameter than a tubing seat to hold the device on the seat, and the profile further being re-configurable to radially retract.

According to a further aspect of the invention there is provided a downhole method comprising: locating an activating device defining an activation profile in downhole tubing; configuring the activation profile to maintain a larger diameter than a seat provided in the tubing; retaining the device on the seat; and re-configuring the profile such that the profile radially retracts and the device passes through the seat.

Alternative features of these aspects are described in the appended dependent claims.

According to another aspect of the present invention there is provided a downhole bypass valve comprising:

a tubular body including a side port;

a sleeve axially movably mounted in the body and defining an internal activation seat of a first diameter, the sleeve normally biased upwards to a closed position to close the side port;

an activating device having an external activation profile defining an activation diameter larger than said first diameter, the device configured to be translatable into the body to engage the activation profile with the activation seat and permit application of a fluid pressure opening force to the device and the sleeve to move the sleeve downwards to an open position and open the side port; and a latch having a part in the body and a part in the activating device, the parts of the latch configured to engage when the activation seat and profile are engaged and retain the sleeve in the open position, the activating device further being operable to disengage the activation profile from the activation seat so that the activation device is translatable down through the sleeve and the parts of the latch further being operable to disengage and permit the sleeve to return to the closed position.

According to another aspect of the present invention there is provided a method of operating a downhole bypass valve having a tubular body including a side port and a sleeve mounted in the body and normally biased upwards to close the port, the method comprising:

landing an activating device in the valve such that an external activation profile provided on the sleeve engages an internal activation seat on the sleeve;

applying a fluid pressure opening force to the activating device and the sleeve to move the sleeve downwards and open the side port;

engaging a latch part in the body with a latch part in the activating device to retain the sleeve in the open position;

passing fluid through the side port;

disengaging the activation profile from the activation seat;

translating the activating device down through the sleeve; and disengaging the parts of the latch, permitting the sleeve to return to the closed position.

In a variation of the second aspect of the invention the activation profile and seat may remain engaged, as may the parts of the latch, such that the sleeve remains in the open position. This may be useful to facilitate dry tripping of a drill string including the valve, as will be described below.

The opening of the valve may only require the presence of a single activating device, simplifying activation and operation of the valve. This contrasts with other valves which require the presence of multiple activating balls or the like, or the use of specified pressure cycles, which increase the time required to activate the valve and which tend to increase the risk of malfunction.

The operation of the latch to retain the sleeve in the open position requires the presence of the activating device in the body. Thus, in the absence of the activating device, either prior to landing the activating device in the sleeve or after the device has been translated down through the sleeve, the operator may be confident that the sleeve is closed. This contrasts to proposals in which sleeve position relies on interaction between the sleeve and the body, and it may be difficult for the operator at surface to determine or predict the sleeve position at any instant.

The sleeve may be solely axially movable, simplifying construction and operation of the valve. Alternatively, the sleeve may also rotate relative to the body.

In one embodiment the sleeve is intended to move to the open position only when the activating device lands in the sleeve, and then remain in the open position while the activating device is in place. The sleeve is intended to return to the closed position only once the latch is disengaged as the activating device moves out of the sleeve. Thus, in contrast to many existing fluid pressure-actuated tools, the sleeve will not move or cycle in response to normal flow or pressure changes unrelated to the operation of the valve. Flow and pressure changes may occur every time the operator turns the surface pumps on and off, bleeds off pressure from the bore, or raises or lowers the valve in the bore. The sleeve, and any associated seals, gaps, mechanisms and voids, are thus far less likely to be affected by the presence of drilling mud, LCM and the like. Drilling mud and LCM is intended to fill pores or gaps in the wall of the drilled bore and as a consequence also have a tendency to fill and pack-off gaps and voids in downhole tools. If a tool is cycled frequently the mud and LCM is more likely to be drawn into any gaps and voids in the tool and if a seal then moves through the filled gap or void the seal may be subject to wear or damage and is more likely to be displaced. Alternatively, the parts of the tool that are intended to move may simply jam or seize. Such a failure almost always costs the operator hundreds of thousands of dollars in downtime and could cost millions of dollars depending on the situation and the size of the drilling rig.

One of the most common forms of LCM is calcium carbonate (like chalk or limestone). This material is used in part because it is acid soluble and may subsequently be dissolved to improve the flow of oil or gas into the well. Calcium carbonate is one of the main ingredients of cement and the cement-like qualities of the material render it particularly effective in jamming down hole mechanisms.

The use of the activating device to control opening and closing of the sleeve facilitates provision of a sleeve of relatively simple construction and operation. Thus, embodiments of the valve do not require provision of J-slots, cams and the like, or anything other than a minimum of moving parts, which would otherwise add complexity to the operation of the valve and potentially impact on valve reliability. Also, it is not unusual for tools provided with J-slots and the like to "double-cycle" in response to an action intended to move the tool only one cycle or one step along a cam track or J-slot, such that the operator on surface may not be aware of the true tool configuration. If considered necessary or desirable, the activating device may be of relatively complex construction, or may comprise parts or elements which might not be expected to remain totally reliable with prolonged exposure to downhole conditions: the activating device may be stored in clean conditions on surface until the valve is to be activated, and delivery through the mud in the drill string should only take 5-25 minutes. Once in place top seals can prevent any LCM getting into activating device mechanisms and the device may only be engaged with the sleeve for a matter of hours, until the bypass operation has been completed.

The valve will typically be mounted in a drill string, and may be located in or above the bottom hole assembly (BHA). Where the valve is provided with the intention of delivering LCM into the annulus, the valve will typically be located above the MWD tool in the BHA, such that the MWD tool is protected from exposure to LCM. Furthermore, the valve may be configured such that many elements of the valve, including the activating device, are isolated or only minimally exposed to LCM being delivered via the valve. Of course embodiments of the valve may be provided in other forms of tubing and at other locations in a tubing string.

References to "upward" and "downward" relate to the normal orientation of the valve in a drilled hole or bore, with upward being towards surface and downward being towards the distal end of the bore. Of course the valve may be located in a horizontal or inclined bore in which the "upper" end of the valve is level with or below the "lower" end of the valve.

References made herein to dimensions expressed as diameters are not intended to be restricted solely to circular parts, and those of skill in the art will realise that similar utility may also be achieved using parts with radially extending elements which do not necessarily define or describe a circular form.

The sleeve may define a port that is aligned with the side port when the sleeve is in the open position. Appropriate seals may be provided between the sleeve and the body to ensure that the side port is sealed closed when the sleeve is in the closed position. One or a plurality of side ports may be provided and one or a plurality of cooperating ports may be provided in the sleeve.

The latch may include a catch and a latch member biased or otherwise configured to engage the catch. The catch may be configured to permit translation of the latch member relative to the catch in one direction and resist translation relative to the catch in the opposite direction. The latch may be configured to permit translation of the activating device downwards relative to the body and resist translation of the device upwards relative to the body. Translating the activating device down through the sleeve following disengagement of the profile and seat may disengage or release the latch.

The provision of the latch permits the valve to be maintained open irrespective of fluid flow or pressure. This offers a number of advantages, including the ability to dry trip. When a string is being tripped or retrieved from a bore the uppermost pipe stand is separated from the pipe string with the lower end of the stand a short distance above the rig floor. If the string is being retrieved "wet", the uppermost stand may be at least partially filled with drilling mud or other fluid. Clearly the presence of the fluid complicates the tripping process: the fluid will drain from the stand and must be safely captured and contained. However, if a slug of dense fluid is pumped into the top of a string that features an open bypass valve the dense slug displaces the lighter fluid in the string into the annulus and the fluid level within the string falls below the coupling between the uppermost stand and the remainder of the string.

The latch may also ensure that the sleeve does not move as the fluid pressure or flow rate of fluid through the valve varies. This contrasts with many existing arrangements which rely on a predetermined flow-induced pressure differential being maintained to hold the valve open. The pressure differential tends to drop sharply each time the valve opens, such that the valve tends to chatter or flutter. This results in accelerated wear of seals and other parts, and may accelerate ingress of particles past seals, increasing the likelihood of valve failure.

The locking open of a valve by a latch arrangement combined with the provision of an activating device which closes the sleeve below the side port also permits U-tubing to occur harmlessly above the valve; U-tubing may occur after pumping LCM into the annulus at the bottom of the hole, when the surface pumps are shut down and some of the surface pipe is pulled out of the hole to pull the BHA above the LCM in order to prevent the BHA getting stuck in the LCM as it settles out. The presence of the LCM, such as calcium carbonate, raises the density of the fluid in the annulus and this relatively dense fluid will tend to flow from the annulus into the string. In the absence of the open valve, fluid from the annulus would likely flow into the string via the jetting nozzles at the distal end of the string and would carry cuttings, LCM and the like into the string, potentially damaging or blocking the nozzles, MWD tools and the like in the BHA.

The open side port also ensures that the U-tube effect does not result in a fluid pressure force tending to push the activating device upwards, out of the sleeve. However, even in the presence of such a force, the latch will tend to retain the activating device in place.

This locking open of the side port also facilitates reverse circulation, that is where fluid flows from surface down the annulus and up through the string. The fluid may flow from the annulus to the string via the open side port, safely bypassing MWD tools and nozzles below the valve. If the BHA has become differentially stuck to the side of the hole due to hydrostatic mud pressure, the level of the annulus can be temporarily lowered to reduce the bottom hole hydrostatic pressure in order to free the BHA. However, this requires the ability to reverse circulate and most BHAs are configured to make it very difficult, or impossible, to reverse circulate.

The activating device may be configured such that the device may be dropped into a string in which the valve is mounted, typically a drill string, and will travel through the string to land in the sleeve with little or no requirement to pump fluid after the device. This may be useful in situations where fluid losses are being experienced, and it is preferred to avoid pumping additional fluid into the bore. Accordingly, the activating device may include relatively dense material, such as metal, and be configured to provide clearance with the narrowest sections of the string, such that the device will travel relatively quickly.

Alternatively, the activating device may be configured to facilitate pumping of the device through the string. To this end, the activating device may include one or more wiper cups sizes to match the size or sizes of the drill pipe in the string above the valve. This permits the device to be translated through high angle and horizontal sections of string and also permits more accurate tracking of the position of the device from surface, by monitoring the volume of fluid pumped into the string behind the device. This facility is particularly useful in high angle wells when low flow rates are available. Furthermore, it may be possible to pump LCM directly behind such a device.

One or both of the activation seat and activation profile may be reconfigurable to permit the seat and the profile to disengage. For example, one or both of the seat or the profile may be deformable or retractable. The seat or profile may be of a relatively soft material, for example a plastics material or aluminium, such that one or both of the seat or profile may be extruded or otherwise deformed to permit the activation device to pass through the sleeve. One of the seat or profile may be a softer material and the other of the seat or profile may be a harder material. Typically, the seat will be relatively hard such that the seat does not suffer wear or damage from passing fluid or other tools. An extrudable portion of the profile may have a substantially constant cross section in the axial direction, for example the extrudable portion may be cylindrical. The extrudable portion, and indeed the valve, may incorporate one or more of the features described in applicant's co-pending patent application WO 2008/146012, the disclosure of which is incorporated herein in its entirety by reference.

The valve may further comprise a release device configured to be translatable into the body to engage the activating device and reconfigure the activation profile to define a release diameter smaller than said first diameter, whereby the activating device may pass through the seat. Alternatively, the release device may be configured to reconfigure the activation seat to describe a release diameter larger than the activation diameter.

The release device may be configured to provide a close fit within the sleeve, whereby a fluid pressure force may be applied to the release device. The release device may include external seals. The release device may be configured to permit application of a mechanical force by the release device to a selected part of the activating device. The release device may be configured to close the side port.

The activation profile may be retractable or collapsible to define a release diameter smaller than said first diameter, whereby the activating device may pass through the seat. Substantially rigid materials such as steel or harder alloys may define the profile. The activation profile may include a radially movable member or members, such as a split ring or dogs, supported in an extended position, removal of the support permitting radial retraction of the member. The support may take the form of a member having tapered or stepped support surfaces. The support may be retained in a supporting position by releasable retainers, such as shear couplings.

In the retracted or collapsed configuration the activation profile may be arranged to provide little if any resistance to movement of the activation profile past the activation seat.

The use of a retractable or collapsible activation profile may provide a greater degree of reliability and control than an extrudable or deformable profile; in use it is not unknown for extrudable activating devices to be blown through seats, or for difficulties to be experienced when attempting to extrude devices through seats. When pumping an activating device into place it is common practice to slow the rate of pumping as the device approaches the seat. However, even with this precaution, the landing of such a device on the seat and the sudden stopping of the pressurised column of fluid following the device generates a very significant pressure pulse on the device. The inertia of the sleeve, and the static friction between the sleeve and the body, also increase the likelihood of an activating device being blown through the seat before the sleeve is moved to the open position. It will also be understood that changes in ambient conditions will vary the force required to extrude a device through a seat, for example the force necessary to extrude a device formed of a thermoplastic material through a seat may decrease as the temperature of the device increases. Other conditions, such as mud properties or the nature of the particles suspended in the mud, may significantly increase the blow-through pressure, making it difficult to displace the device from the valve. Indeed, the device will plug the string if the pressure necessary to extrude the device through the seat rises above the surface pump capacity; for a driller this is a very bad and costly position to be in.

The activation profile may be configured to retract or collapse on application of a mechanical force to an activation profile release arrangement, which mechanical force may be applied by a release device placed in the string by the operator at an appropriate point. The profile may thus, in normal usage, be substantially unaffected by application of fluid pressure forces typically experienced in the well such that it is most unlikely that the activating device will be inadvertently blown through the sleeve or released due to pressure pulses or spikes. Thus, the operator can be confident that the side port will be opened on the activating device landing on the sleeve. The release arrangement for the activating device may include a support member with a relatively small cross-section release portion exposed to the fluid pressure acting above the activating device such that any pressure differential across the support member is applied to a small area and only generates a relatively small force. The release portion may be configured to cooperate with an appropriate release device or other arrangement. However, the tool may be configured such that at certain, relatively high pressures, the force generated by the pressure differential alone may be sufficient to release the activating device. These pressures may be selected to be within the upper ranges of pressure differentials achievable using the standard pumps and procedures available to the operator, or may be achievable only using special procedures or apparatus.

The activation profile may be provided towards an upper end of the activating device. The latch part of the activating device may be provided towards a lower end of the activating device. The latch part in the body may be provided below a lower end of the sleeve, such that the latch part on the activating device must pass through the sleeve and the activation seat before engaging the body latch part. The latch part on the activating device may be biased or otherwise configured to define a diameter larger than the first diameter and may be flexible or otherwise deformable or deflectable to facilitate passage of the latch part through the sleeve. The latch part on the body may define an internal diameter larger than the first diameter, to avoid fouling of the activation profile as the activating device passes through the body latch part. Alternatively, or in addition, the latch part on the body may be flexible, which may facilitate passage of the activation profile, and may define a smaller diameter than the first diameter. The activating device may be elongate to provide appropriate axial spacing between the activation profile and the latch part and also to prevent the device reversing its orientation while travelling through the string from surface, although having the body latch below the activation profile will tend to result in the activating device being more than double the length required to prevent reverse orientation. While it is possible that shorter activating members may be provided in accordance with the present invention it is likely that the activating devices will be at least 25% longer than the biggest internal diameter of pipe that the device must travel through between surface and the tool. The provision of such an elongated activating device also facilitates provision of wiper cups in the section of the device between the activation profile and the latch part in applications where it is desired to pump the activating device into place. However, the provision of such an elongated activating device does present a significant disadvantage, in that any catcher provided below the valve has to be long enough to accommodate the device following reopening of the valve. Furthermore, if it is desired to provide the opportunity for multiple activations of the valve, the catcher must be long enough to accommodate multiple devices. All other multi-functioning drilling valves not supplied by the applicant use balls as the activating and de-activating device. The vast majority of tools are activated by dropping a ball into them; the ball is generally considered the best shape to travel down a string. Having such an elongated activating device will required the associated activating device catcher to be about ten times longer than the equivalent ball catcher. Such activating devices also require careful design to minimise the chances of being inadvertently stopped before the device gets to the tool.

The location of the latch part below the activating profile facilitates provision of a relatively unobstructed flow path from the valve body into the annulus via the side port. This minimises pressure losses, maximises flow and reduces the likelihood of blocking the valve or string above the side ports. However, in other embodiments the latch part on the activating member may be provided above the activating profile.

The latch may be configured to provide little or no resistance to downward movement of the activating device through the sleeve, facilitating engagement of the activating profile and seat and opening of the side port, and furthermore facilitating translation of the device out of the sleeve following disengagement of the activation profile and seat.

The latch part on the body may be provided on a non-moving portion of the body, which portion may be formed by a part fixed to the body, the sleeve being axially movable relative to the non-moving portion.

The activating device may be configured to prevent fluid passage through the sleeve, whereby fluid may only pass through the side port after the device has landed in the sleeve and the sleeve has been moved to the open position. This condition is sometimes referred to as 100% bypass. Alternatively, the activating device may be configured to permit fluid passage through the sleeve, or split flow, that is a proportion of the fluid passing into the string is directed through the open side port while a proportion of fluid passes into the string beyond the valve. This may be useful in bore cleaning operations, allowing a portion of fluid to continue to flow to the distal end of the string to provide cooling of stabilisers and the like and to maintain movement of cuttings in the bore below the valve. The activating device may include a nozzle or other flow restriction to facilitate application of a fluid pressure force to move the sleeve to the open position and engage the latch. The nozzle may be erodable, to permit a higher rate of flow through the activating device once the sleeve is in the open position. Alternatively, the activating device may include a burst disc or a dissolvable plug. Activating devices in accordance with aspects of the invention intended to provide split flow in a bypass valve may include an erosion resistant flow surface. This may be provided by a suitable coating or hard facing, or the devices may incorporate sleeves or liners of erosion resistant material, such a ceramics.

The activation seat may have a relatively small radial extent, for example 2 mm or less. This minimises the flow and access restriction created by the seat. Thus, the bore diameter of the sleeve above the seat may be only very slightly larger than the seat. This permits provision of a release device which, by provision of a flexible or deformable external seal, forms a sliding sealing contact with the sleeve bore. The release device may thus act as a piston and translate a fluid pressure force applied by the fluid above the release device to a mechanical force to be applied to the activating device. The flexible seals of the release device then permit the release device to pass through the seat. Similarly, seals provided on the activating device may provide a sealing sliding contact with the sleeve bore above the seat and be deformed or compressed to permit the device to pass through the seat.

The valve may further comprise a catcher for location below the body and to receive one or more activating devices. The catcher may also be arranged to receive one or more release devices. The catcher may be configured to permit fluid passage around any devices retained in the catcher.

A plurality of activating devices may be provided, allowing multiple activations of the valve without requiring retrieval and resetting of the valve at surface. The activating devices may be of different forms or constructions, such that the utility or function of the valve may be varied, merely be selection of an appropriate activating device. Thus a single body and valve combination may provide multiple functions. One of the activating devices may not feature a latch part as described above, use of such a device allowing the sleeve to be moved to the open position when fluid is flowing into the tool, but allowing the sleeve to move to the closed position when flow ceases. Such a form of activating device may be employed in situations where well control is an issue and it is desired that the valve will always close in the absence of flow from surface. This activating device may be configured to latch or lock within the sleeve, such that the activating sleeve will not be dislodged or displaced from the sleeve. Such an activating device forms a further aspect of the present invention, and may tend to be shorter than activating devices as described above which are required to latch with the body below the end of the sleeve. Accordingly, a larger number of such activating devices may be accommodated in a given catcher located below the valve, increasing the number of cycles achievable. Alternatively, a shorter catcher may be provided.

The various features and advantages described above may equally apply to the various aspects of the invention described below.

According to another aspect of the present invention there is provided a downhole bypass valve comprising:

a tubular body including a side port;

a sleeve axially movably mounted in the body and normally biased to a closed position to close the side port;

an activating device configured to be translatable into the body to engage the sleeve and permit movement of the sleeve to an open position and open the side port; and a latch having a part in the body and a part in the activating device, the parts of the latch configured to engage and retain the sleeve in the open position, the activating device further being operable to disengage from and translate through the sleeve and the parts of the latch further being operable to disengage and permit the sleeve to return to the closed position.

According to another aspect of the present invention there is provided a method of operating a downhole bypass valve having a tubular body including a side port and a sleeve mounted in the body and normally biased to close the port, the method comprising:

landing an activating device in the sleeve;

moving the sleeve to open the side port;

engaging a latch part in the body and a latch part in the activating device to retain the sleeve in the open position, passing fluid through the side port;

disengaging the activating device from the sleeve;

translating the activating device through the sleeve; and disengaging the parts of the latch, permitting the sleeve to return to the closed position.

The sleeve may include a seat adapted to engage a cooperating part or profile of the activating device. The seat may be provided internally of the sleeve, and may take the form of a bore restriction. The cooperating part of the activating device may take any appropriate form and may be an external profile. One or both of the seat and profile may be reconfigurable to permit the seat and profile to disengage. For example, one or both of the seat or the cooperating part may be deformable or retractable.

According to another aspect of the present invention there is provided a downhole tool comprising:

a tubular body;

an operating member axially movably mounted in the body and initially located in a first position;

an activating device configured to be translatable into the body to engage the operating member and permit movement of the member to a second position; and a latch having a part in the body and a part in the activating device, the parts of the latch configured to engage and retain the operating member in the second position, the activating device further being operable to disengage from the operating member and the parts of the latch further being operable to disengage.

The operating member may provide a function including at least one of: opening or closing a valve, actuating a seal or packer, and controlling the extension or retraction of external members, which external member may be cutting blades.

Another aspect of the invention relates to a downhole tool comprising:

a tubular body;

an operating member axially movably mounted in the body and initially located in a first position;

an activating device configured to be translatable into the body to engage the operating member and permit movement of the member to a second position; and a latch configured to retain the operating member in the second position, the activating device further being operable to disengage from the operating member and the latch further being operable to disengage.

According to another aspect of the present invention there is provided a method of operating a downhole tool having a tubular body and an operating member mounted in the body, the method comprising:

landing an activating device in the tool;

moving the operating member from a first position to a second position;

engaging a latch part in the body with a latch part in the activating device to retain the operating member in the second position; and disengaging the parts of the latch whereby the operating member may return to the first position.

The operating member may provide or serve any appropriate function. For example, the member may open or close a valve, actuate a seal or packer, or may control the extension or retraction of external members, such as cutting blades provided on a reamer.

According to another aspect of the present invention there is provided a method of operating a downhole tool having a tubular body and an operating member mounted in the body, the method comprising:

landing an activating device in the tool;

moving the operating member from a first position to a second position;

engaging a latch to retain the operating member in the second position; and disengaging the latch whereby the operating member may return to the first position.

According to another aspect of the present invention there is provided a downhole tool comprising:

a tubular body;

a sleeve axially movably mounted in the body and defining an internal activation seat of a first diameter;

an activating device having an external activation profile defining an activation diameter larger than said first diameter, the device configured to be translatable into the body to engage the activation profile with the activation seat, at least one of the activation seat and the activation profile being reconfigurable to retract and define a release diameter, whereby the activating device may pass through the seat.

The tool may further comprise a release device configured to be translatable into the body to engage the activating device and reconfigure the activation profile to define a release diameter smaller than said first diameter, whereby the activating and release devices may pass through the seat. Alternatively, the release device may reconfigure the activation seat. In other embodiments, at least one of the activation seat and the activation profile may be reconfigurable to retract in response to a signal or condition, for example an elevated pressure, which elevated pressure may be towards the upper end of the available pressure, or may be above the normally available pressure. Such embodiments may also be reconfigurable using an appropriate release device.

According to another aspect of the present invention there is a method of operation a downhole tool having a tubular body and a sleeve mounted in the body, the method comprising:

providing an internal activation seat of a first diameter in the sleeve;

landing an activating device in the tool such that an external activation profile on the device defining an activation diameter larger than said first diameter engages the activation seat;

engaging the activating device with a release device thereby reconfiguring the activation profile to define a release diameter smaller than said first diameter; and passing the activating and release devices through the seat.

In alternative embodiments there is provided a downhole tool comprising:

a tubular body defining an internal seat of a first diameter;

an activating device having an external profile defining a diameter larger than said first diameter, the device configured to be translatable into the body to engage the profile with the seat, at least one of the profile and the seat being retractable to define a release diameter, whereby the activating device may pass through the seat.

The external profile may be defined by one or more profile members. In an extended configuration the profile member may be radially supported, and in a retractable configuration the profile member may be movable radially inward to define the release diameter.

The activating device may be reconfigured by engagement with a release device, such as described with reference to the seventh or other aspects of the invention. Alternatively, or in addition, the activating device or the internal seat maybe reconfigured by application of fluid pressure or by some other activation signal. Where the release device is configured to provide a close fit with the body or a sleeve mounted in the body and would otherwise trap a volume of fluid between the release device and the activating device, the tool may comprise a relief valve for relieving pressure from the volume between the devices.

The tool and activating device may include one or more of the features of the tools and activating devices of the other aspects of the invention described herein. The activation device may take the form of a plug, valve, choke, logging device or indeed any downhole device it is desired to releasably locate in a bore.

According to another aspect of the present invention there is provided a downhole bypass valve comprising:

a tubular body including a side port;

a sleeve axially movably mounted in the body and defining an internal activation seat of a first diameter, the sleeve normally biased upwards to a closed position to close the side port;

an activating device having an external activation profile defining an activation diameter larger than said first diameter, the device configured to be translatable into the body to engage the activation profile with the activation seat and permit application of a fluid pressure opening force to the device and the sleeve to move the sleeve downwards to an open position and open the side port; and a latch having a part in the sleeve and a part in the activating device, the parts of the latch configured to engage when the activation seat and profile are engaged to retain the activating device in the sleeve and the activation profile and activation seat in engagement, the activating device further being operable to disengage the activation profile from the activation seat so that the activation device is translatable down through the sleeve.

According to another aspect of the present invention there is provided a method of operating a downhole bypass valve having a tubular body including a side port and a sleeve mounted in the body and normally biased upwards to close the port, the method comprising:

landing an activating device in the valve such that an external activation profile provided on the sleeve engages an internal activation seat on the sleeve and a latch part on the activating device engages a latch part on the sleeve to retain the activating device in the sleeve and maintain the activation profile and seat in engagement;

applying a fluid pressure opening force to the activating device and the sleeve to move the sleeve downwards and open the side port;

passing fluid through the side port;

disengaging the activation profile from the activation seat; and translating the activating device down through the sleeve.

The latch of these aspects of the invention retains the activating device in the sleeve and maintains the activation profile and the activation seat in engagement. Thus, the activating device will not be dislodged from the sleeve, and reverse flow up through the valve is prevented.

On landing on the sleeve the activating device may provide a substantially sealing contact with the sleeve and the latch may be configured to retain the sealing contact.

Activating devices of these aspects may be configured to provide 100% bypass or split flow.

According to another aspect of the present invention there is provided a downhole bypass valve comprising:

a tubular body including a side port;

a sleeve axially movably mounted in the body and defining an internal activation seat of a first diameter, the sleeve normally biased upwards to a closed position to close the side port;

an elongate activating device having an external activation profile defining an activation diameter larger than said first diameter, the device configured to be translatable into the body to engage the activation profile with the activation seat and permit application of a fluid pressure opening force to the device and the sleeve to move the sleeve downwards to an open position and open the side port; and a latch having a part in the sleeve and a part in the activating device, the parts of the latch configured to engage when the activation seat and profile are engaged to retain the activating device in the sleeve, the activating device further being operable to disengage the activation profile from the activation seat so that the activation device is translatable down through the sleeve.

According to another aspect of the present invention there is provided a method of operating a downhole bypass valve having a tubular body including a side port and a sleeve mounted in the body and normally biased upwards to close the port, the method comprising:

landing an elongate activating device in the valve such that an external activation profile provided on the device engages an internal activation seat on the sleeve and a latch part on the activating device engages a latch part on the sleeve to retain the activating device in the sleeve;

applying a fluid pressure opening force to the activating device and the sleeve to move the sleeve downwards and open the side port;

passing fluid through the side port;

disengaging the activation profile from the activation seat; and translating the activating device down through the sleeve.

Other aspects of the invention relate to the activating device, independently of the other elements of the valve.

According to a still further aspect of the present invention there is provided a method of delivering material into a hole via a tubular string, the method comprising:

opening a bypass port in a tubular string located in a drilled hole, the bypass port being provided above jetting nozzles in the distal end of the string;

delivering material through the string from surface, the material passing through the bypass port and into the drilled hole; and trapping a volume of fluid in the string whereby fluid is prevented from passing from the hole into the string via the jetting nozzles.

According to a yet further aspect of the invention there is provided apparatus for use in delivering material into a hole via a tubular string, the apparatus comprising:

a bypass valve having a bypass port, the valve configured to be located in a tubular string above jetting nozzles provided towards the distal end of the string and the port configured to be opened to permit material to be delivered through the string from surface and into the hole via the port;

a string bore closure member configured to be located in the string bore, whereby a volume of fluid may be trapped in the string and fluid is prevented from flowing from the hole into the string via the jetting nozzles.

These aspects of the invention may be utilised, for example, to protect elements of a BHA, such as an MWD tool, from contamination by LCM which has been delivered into a drilled hole via the bypass valve. The trapped volume of fluid, typically drilling mud or fluid, prevents any further fluid containing LCM from flowing into the string through the jetting nozzles, as may otherwise occur due to U-tubing effects, as described above.

The closure member may be located below the bypass port, and may prevent fluid from flowing down through the string bore.

The closure member may be configured to be dropped or pumped into the string, and may be configured for landing in the bypass valve. Alternatively, the closure member may be configured to be incorporated in the string or bypass valve.

The closure member may be configured to facilitate opening of the bypass port. The closure member may lock or latch the bypass port open, or the bypass port may be closed and opened with the closure member in place.

The closure member may include one or more features of the activation or activating devices of the other aspects of the invention.

In certain embodiments the bypass valve may open or close in response to signals transmitted from surface, for example: pressure pulses or acoustic signals; or by electrical, optical or hydraulic signals or power transmitted from surface via appropriate wiring, cabling or control lines: or by signalling chips or devices pumped into the string.

According to an aspect of the present invention there is provided a downhole bypass valve comprising:

a tubular body including a side port;

a sleeve axially movably mounted in the body and defining an internal activation seat of a first diameter, the sleeve normally biased upwards to a closed position to close the side port:

a plurality of activating devices, each activating device having an external activation profile defining an activation diameter larger than said first diameter, each device configured to be translatable into the body to engage the activation profile with the activation seat and permit application of a fluid pressure opening force to the device and the sleeve to move the sleeve downwards to an open position and open the side port;

at least one activating device configured to occlude the sleeve below the side port;

at least one activating device configured to permit flow through the sleeve below the side port;

at least one activating device configurable to retain the sleeve in the open position; and at least one activating device configurable to retain the activating device in the sleeve.

Thus, a valve may be configured to cooperate with a variety of different activating devices, and each activating device may provide a different functionality for the valve. This may allow a valve of relatively simple construction to perform a variety of tasks, merely by selection of an appropriate activating device, which device may also be relatively simple or may be relatively sophisticated.

The activating devices may be configured to be retrievable from the valve, or may be configurable to be pumped or passed through the valve, in a similar manner to the activating devices of the other embodiments.

Embodiments of these aspects of the invention may utilise activating devices as described above with reference to the other aspects of the invention.

BRIEF DESCRIPTION OF THE DRAWINGS

These and other aspects of the present invention will now be described, by way of example, with reference to the accompanying drawings, in which.

Figure 6:
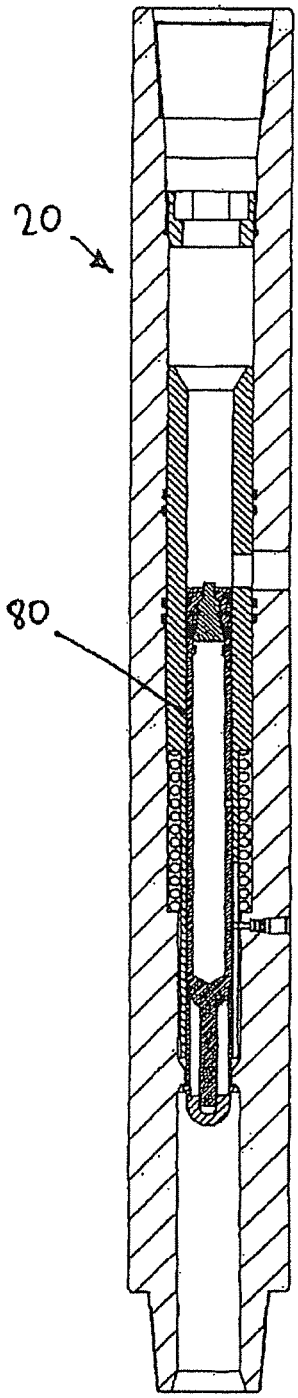
FIG. 6 is a sectional view of a bypass tool in accordance with the present invention, including an alternative form of activating device, illustrated in the open position.
Figure 7:
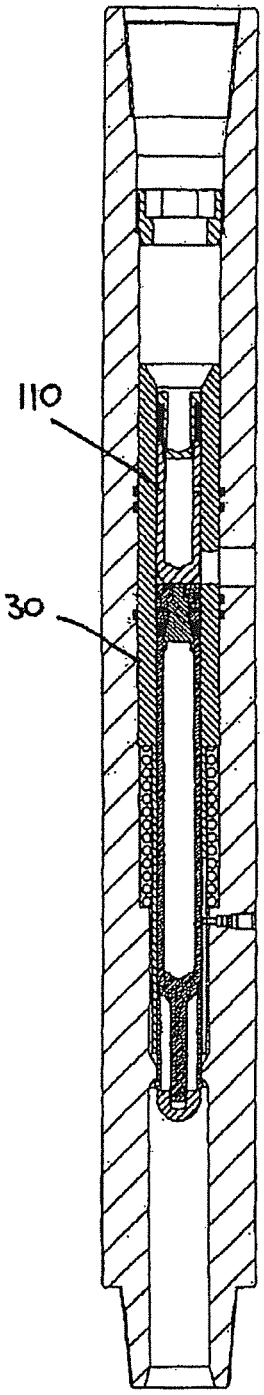
Figure 8:
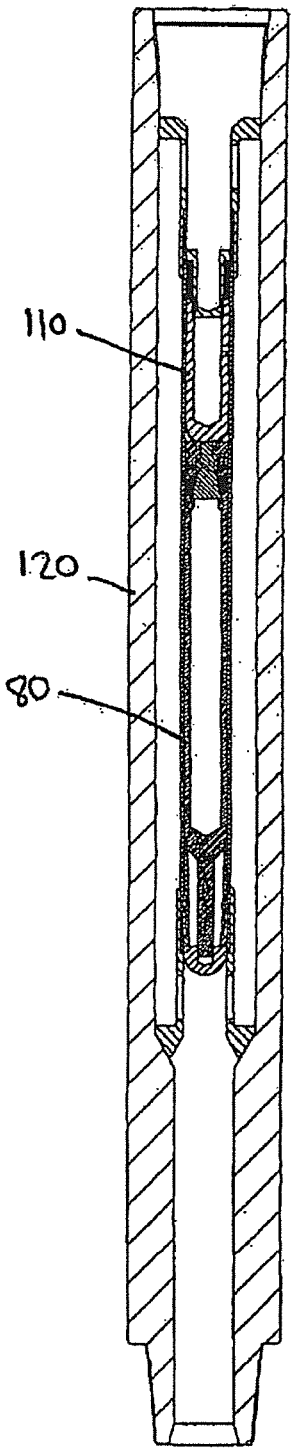
Figure 9:
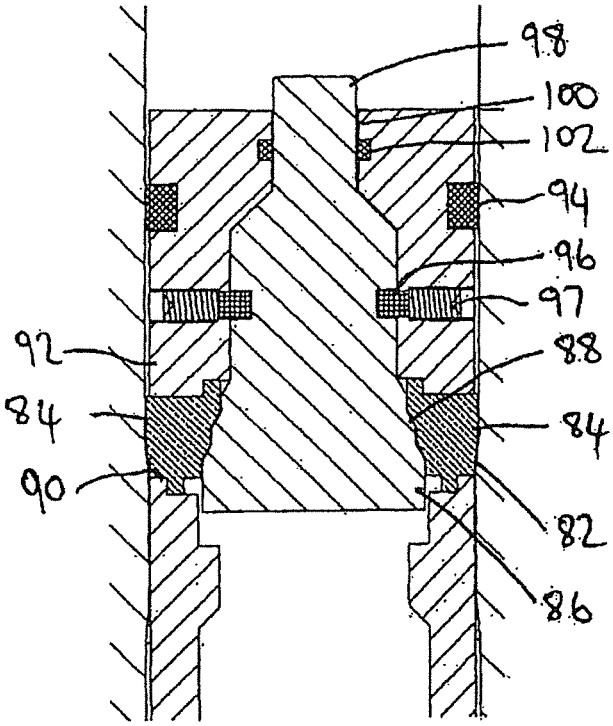
Figure 11:
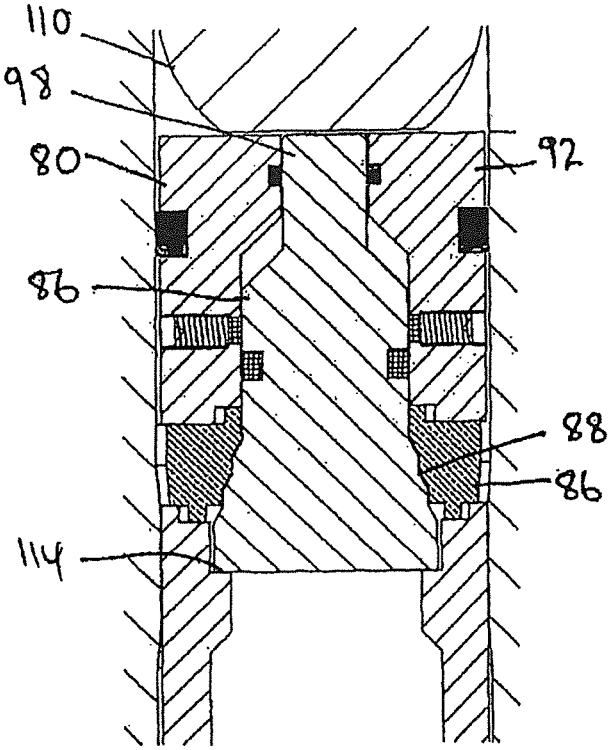
Figure 10:
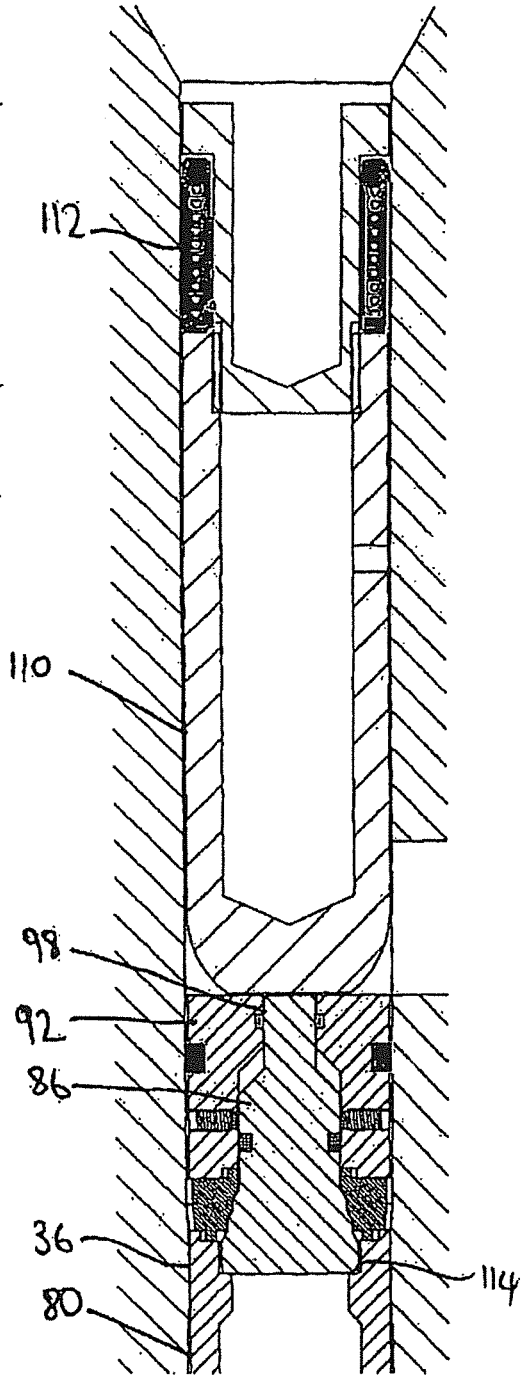
Figure 12:
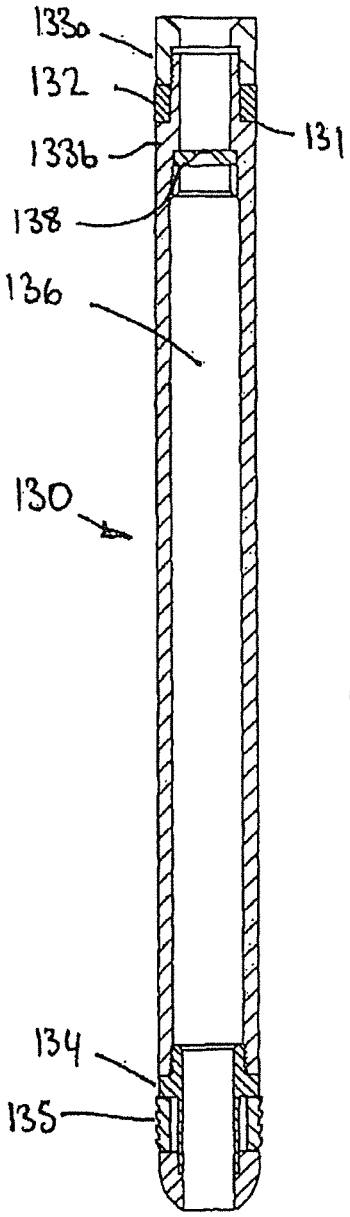
Figure 13:
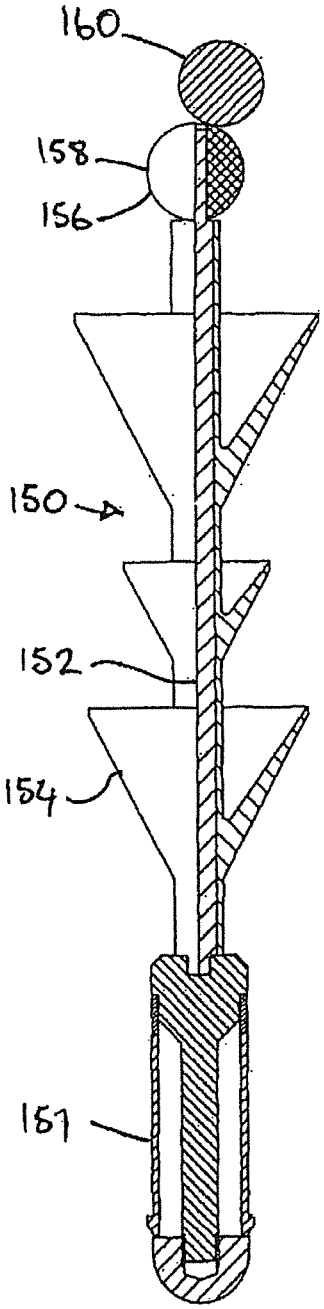
Figure 14:
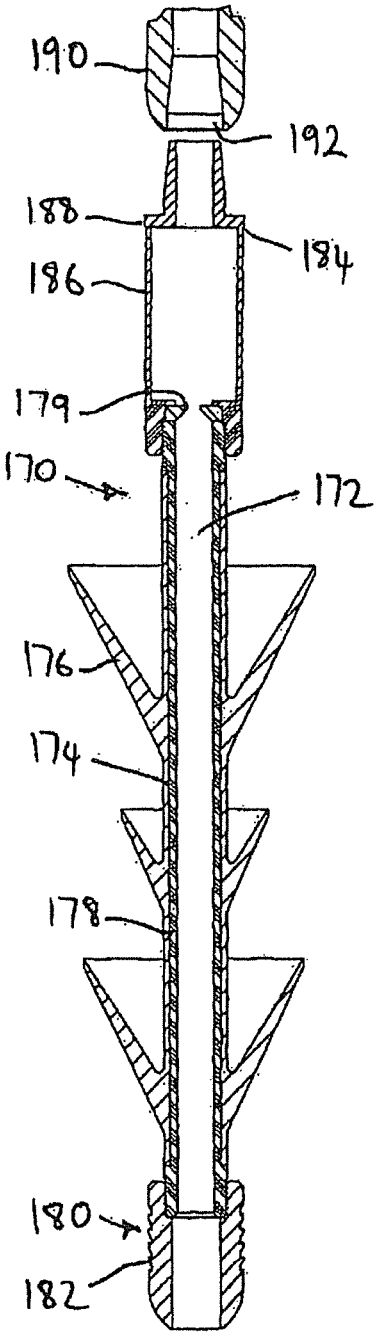
Figure 15:
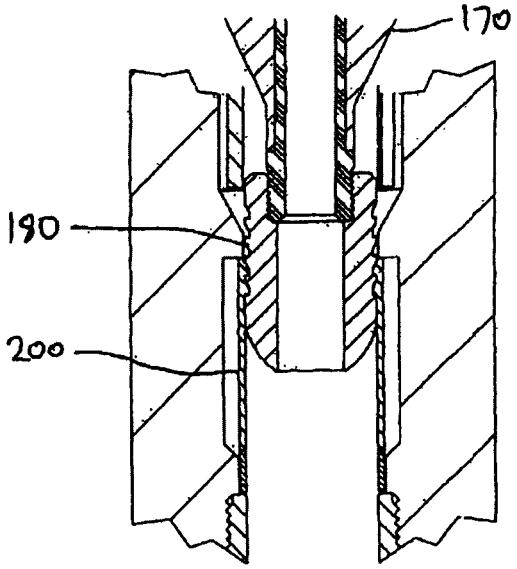
Figure 16:
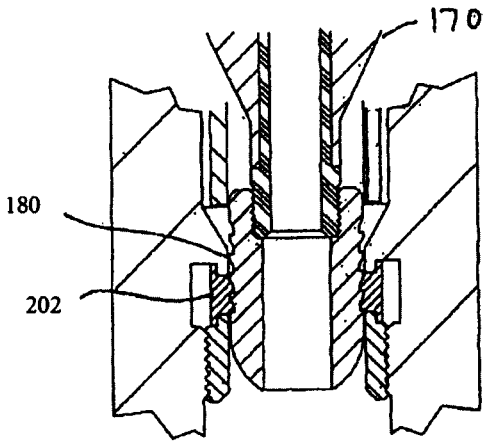
Figure 17:
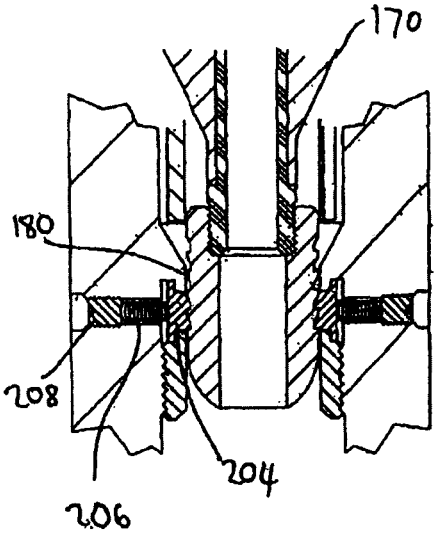
Figure 18:
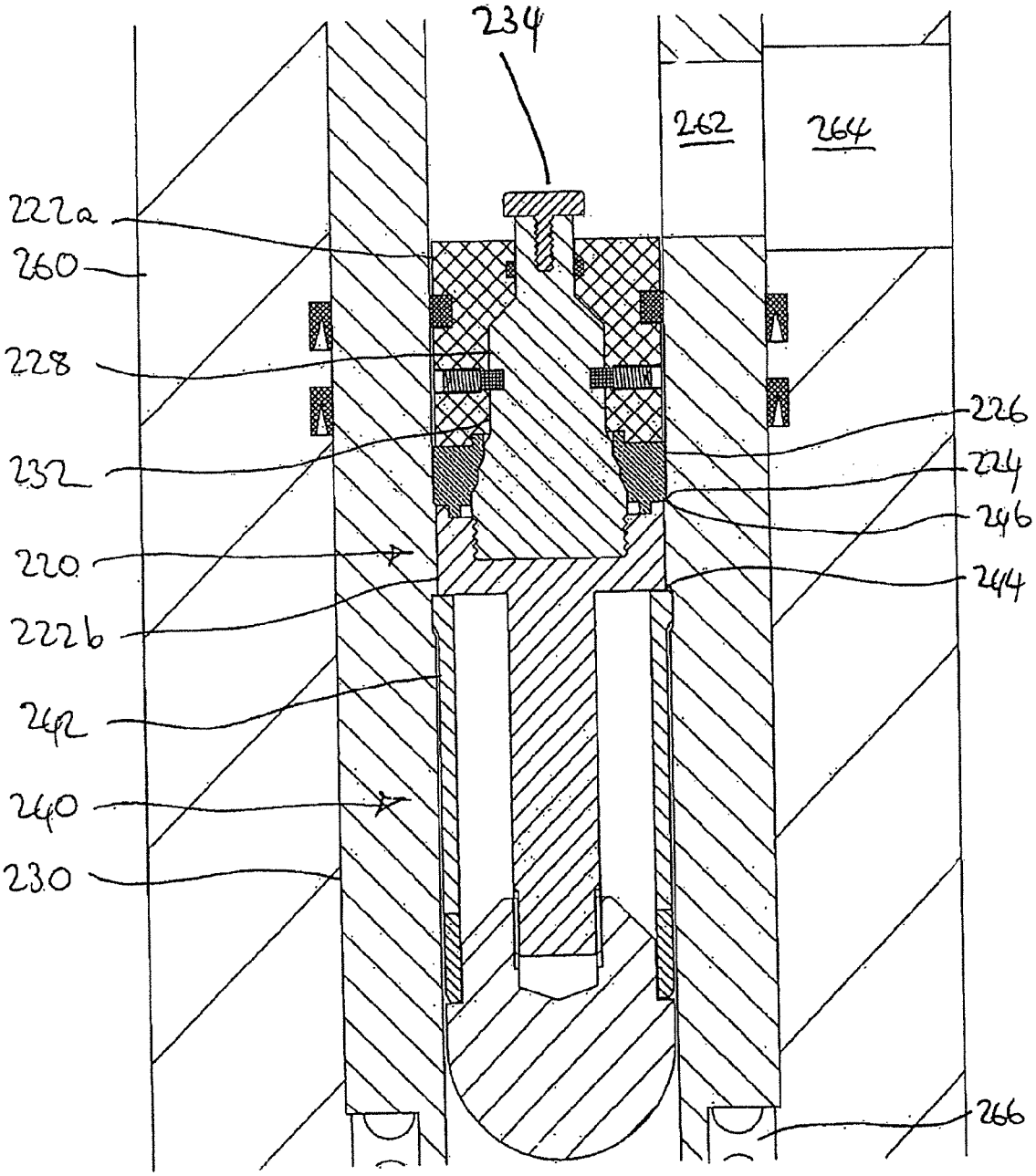
Figure 19:
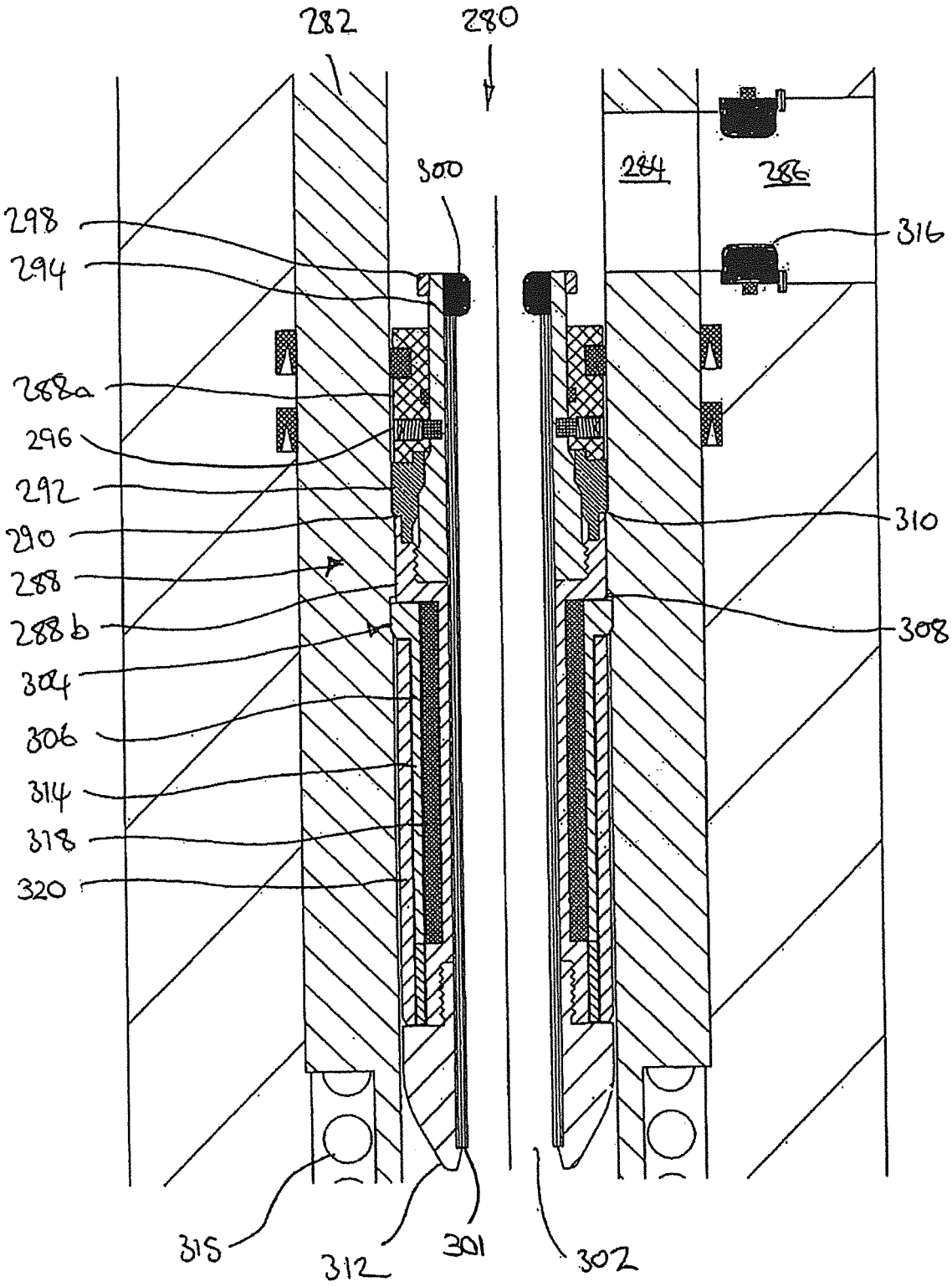
Figure 20:
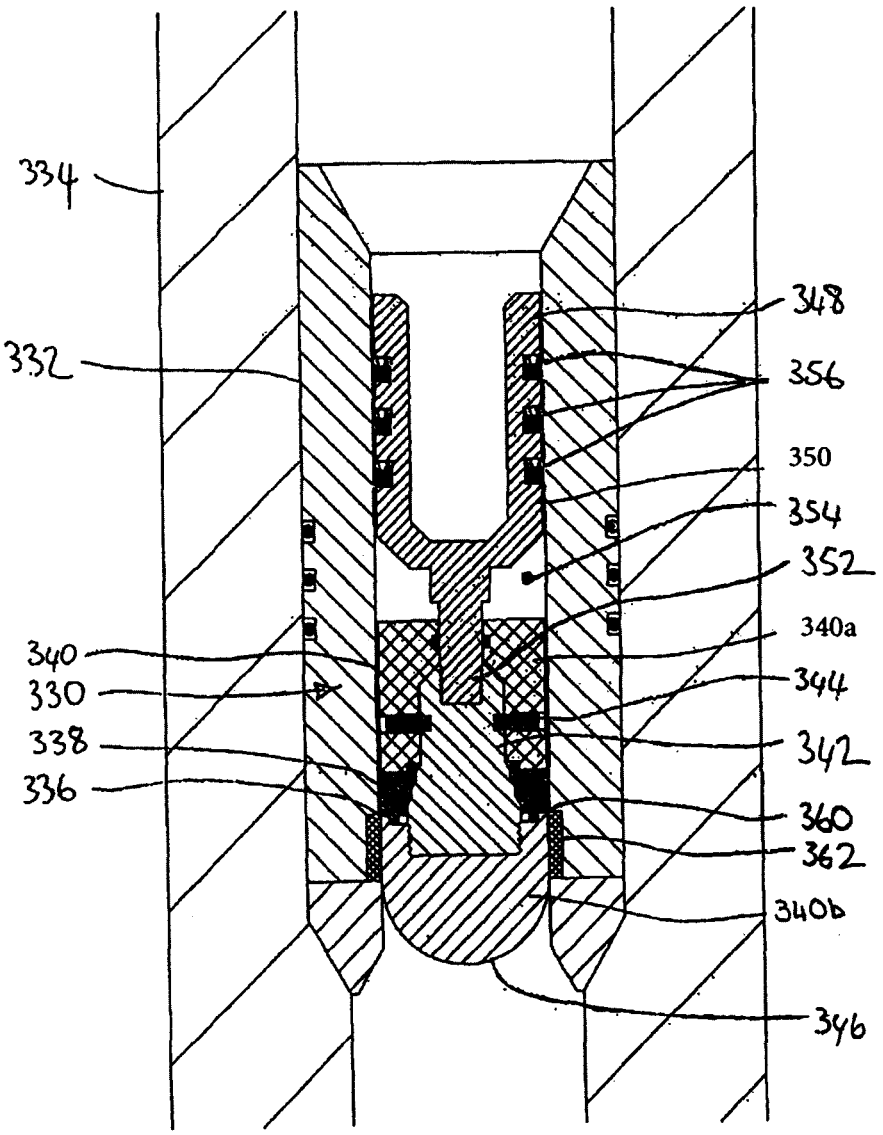

FIG. **6*a*** is a sectional view of a bypass tool in accordance with the present invention including an alternative form of sleeve and activating device;

FIG. 7 shows the tool of FIG. 6 in transition between the open and closed positions;

FIG. 8 is a sectional view of a catcher sub after receiving the activating device and release device of the tool of FIG. 7;

FIG. 9 is an enlarged view of an upper end portion of the activating device of the tool of FIG. 6;

FIG. 10 is an enlarged view of the upper end portion of the activating device and the release device of FIG. 7;

FIG. 11 is an enlarged view of the upper end portion of the activating device of FIG. 7;

FIGS. 12, 13 and 14 are sectional views of alternative forms of activating device in accordance with embodiments of the present invention;

FIGS. 15, 16 and 17 are sectional views of the latch part of the activating device of FIG. 14 in combination with alternative latch parts provided on the body of a tool in accordance with embodiments of the present invention;

FIG. 18 is a sectional view of a further alternative form of activating device located in a bypass tool in accordance with an embodiment of the present invention;

FIG. 19 is a sectional view of a still further alternative form of activating device located in a bypass tool in accordance with an embodiment of the present invention; and FIG. 20 is a sectional view of an activating device located in a downhole tubular in accordance with an embodiment of the present invention.

DETAILED DESCRIPTION OF THE DRAWINGS

Figure 1:
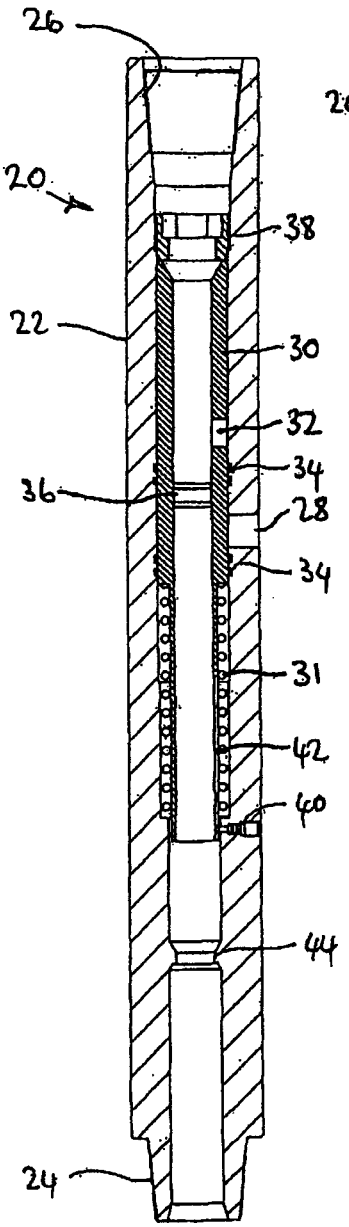
FIG. 1 is a sectional view of a bypass tool in accordance with a first embodiment of the present invention, illustrated in the closed dormant position.

Reference is first made to FIG. 1 of the drawings, which is a sectional view of a bypass tool 20 in accordance with a first embodiment of the present invention, illustrated in the closed dormant position. The tool 20 is intended for location in a drill string (not shown), typically in the BHA, just above the MWD tool. Accordingly, the tool 20 has a substantial tubular body 22 provided with appropriate pin and box connections 24, 26 at its lower and upper ends. During normal drilling operations drilling mud will be pumped from surface through the string to the drill bit on the distal end of the string, the mud passing though the dormant tool 20. However, as will be described below, when considered necessary or desirable a side port 28 in the body 22 may be opened to permit drilling mud, or other fluid, to pass directly from the tool 20 into the annulus surrounding the drill string.

The body 22 accommodates a sleeve 30 which normally closes the side port 28. The sleeve 30 is biased upwards to the closed position by a spring 31. A side port 32 is formed in the sleeve 30 and is normally misaligned with the body side port 28. Sets of seals 34 between the body 22 and the sleeve 30 isolate the side port 28 from the interior of the body 22. The sleeve 30 features an internal hardened activation seat 36 below the side port 32, the seat 36 providing a small reduction in the internal sleeve diameter.

A hollow nut 38 retains the upper end of the sleeve 30. An alignment pin 40 extends from the body and into an axial slot 42 in the lower outer end surface of the sleeve 30. Accordingly, the sleeve 30 may only move axially relative to the body 22.

As will be described, the tool 20 includes a latching arrangement, and a part of the latch, in the form of a body catch 44, is provided towards the lower end of the body 22, below the sleeve 30.

Figure 2:
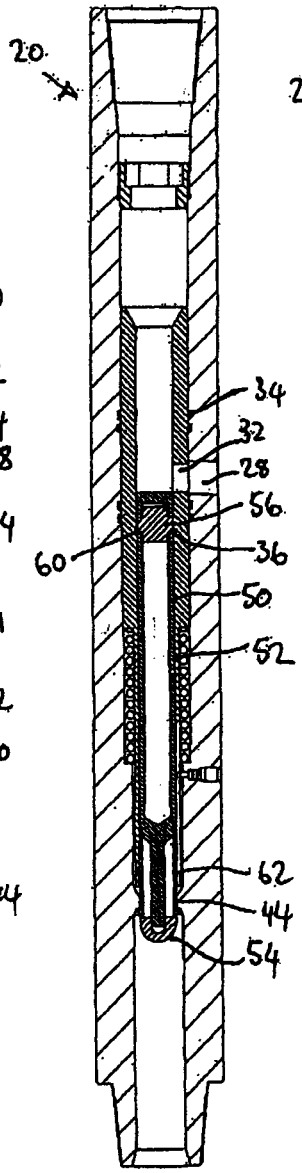
FIG. 2 shows the tool of FIG. 1 in the open position.

Reference is now also made to FIG. 2 of the drawings, which shows the tool 20 of FIG. 1 in the open position. The transition of the tool 20 from the closed position to the open position is achieved by inserting an activating device 50 into the string at surface, which device 50 then drops through the string and lands in the body 22, as will be described below.

The activating device 50 has a generally cylindrical elongate body 52 of a relatively dense and robust material, such as an appropriate metal alloy. The leading end of the body 52 is fitted with a rounded nosepiece 54.

The trailing end portion of the device body 52 includes an insert 56 of relatively soft material, such as a polymeric material or a soft metal, such as aluminium. Upper and lower parts of the body 52*a*, 52*b* are threaded to the insert 56, as more clearly illustrated in FIG. 5 of the drawings. The insert 56 features a circumferential rib 58 which extends between the ends of the body parts 52*a*, 52*b*, beyond the outer diameter of the body 52, to define an activation profile 60. The rib 58 describes an outer diameter smaller than the inner diameter of the sleeve 30 but slightly larger than the inner diameter of the sleeve activation seat 36.

Figure 4:
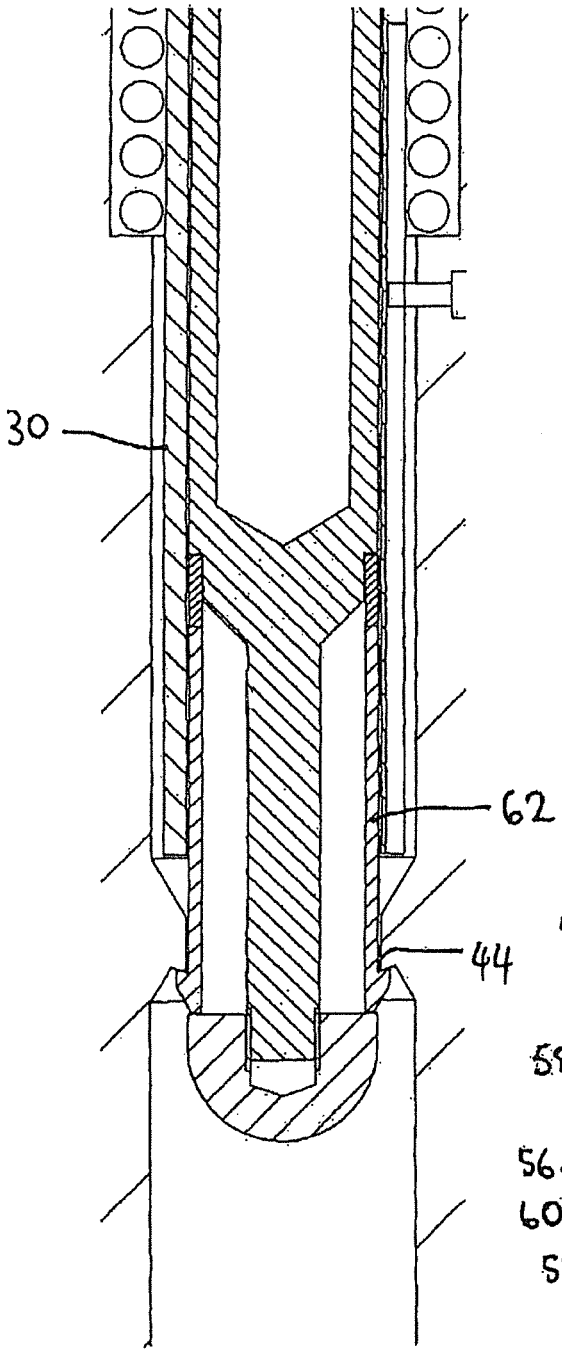
FIG. 4 is an enlarged view of the latching mechanism of the tool of FIG. 2.

The leading end portion of the activating device body 52 carries a collet formed of number of barbed latch fingers 62, as more clearly illustrated in FIG. 4 of the drawings, normally biased to describe an outer diameter larger than that of the body catch 44. Thus, the fingers 62 normally describe a diameter larger than the internal diameter of the sleeve 30.

As noted above, when the operator wishes to open the side port 28, the activating device 50 is inserted into the string at surface and allowed to drop down through the string. Fluid may be pumped into the string behind the device 50 if it is desired to translate the device through the string more quickly, or if the string is inclined. On reaching the tool 20, the activating device 50 passes into the sleeve 30, the latch fingers 62 being deflected inwardly by the flared upper end of the sleeve 30. The device 50 travels down through the sleeve 30 until the activation profile 60 lands on the activation seat 36, at which point the upper end of the device body 52 lies flush with the lower edge of the sleeve port 32 and the ends of the latch fingers 62 extend beyond the lower end of the sleeve 30.

The device 50 now substantially occludes the sleeve 30, such that an increase in the pressure of the fluid in the string above the tool 20 will create a significant differential pressure across the sleeve 30. Given the significant cross sectional area over which the pressure acts (the area defined by the seals 34), a large pressure force acts on the sleeve 30 and moves the sleeve 30 downwards in the body 22, compressing the spring 31.

The sleeve 30 is translated downwards until the ports 28, 32 come into alignment, as illustrated in FIG. 2. With the sleeve 30 in this position relative to the body 22 the free ends of the latch fingers 62 have passed beyond the body catch 44, and thus spring out and engage the catch 44, as illustrated in FIGS. 2 and 4, thus retaining the sleeve 30 in the open position. Fluid may now flow down the string and then flow directly into the annulus through the aligned ports 28, 32.

The latch arrangement 44, 62 ensures that the tool 20 remains open, even if the flow from surface through the string ceases. The open tool 20 may be utilised to, for example, deliver LCM into the bore. The arrangement of the tool 20, and in particular the engagement of the profile 60 with the seat 36, is such that no LCM should pass into the string below the upper end of the activating device 50, whereby MWD tools and the like provided in the string below the tool 20 are protected from the LCM. Also, the spring void and other parts of the tool 20, including all but the upper end face of the activating device 50, that might potentially be plugged or affected by exposure to LCM, are below the upper end of the device 50 and isolated from the LCM.

Figure 3:
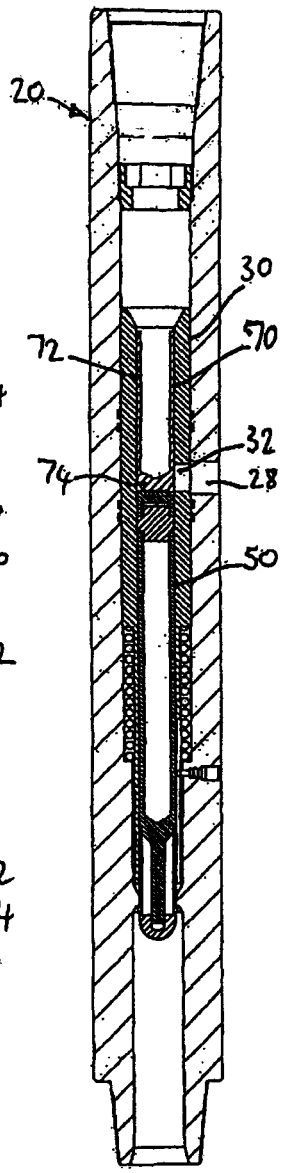
FIG. 3 shows the tool of FIG. 1 in transition between the open and closed positions.

The tool 20 will remain open as long as the activating device 50 remains in the body 22. Returning the tool 20 to the closed position requires the operator to pump a release device 70 down the string and into the tool 20. FIG. 3 of the drawings shows the tool 20 in transition between the open and closed positions, after the release device 70 has passed into the upper end of the sleeve 30, and landed on the upper end of the activating device 50, closing the side ports 28, 32.

Figure 5:
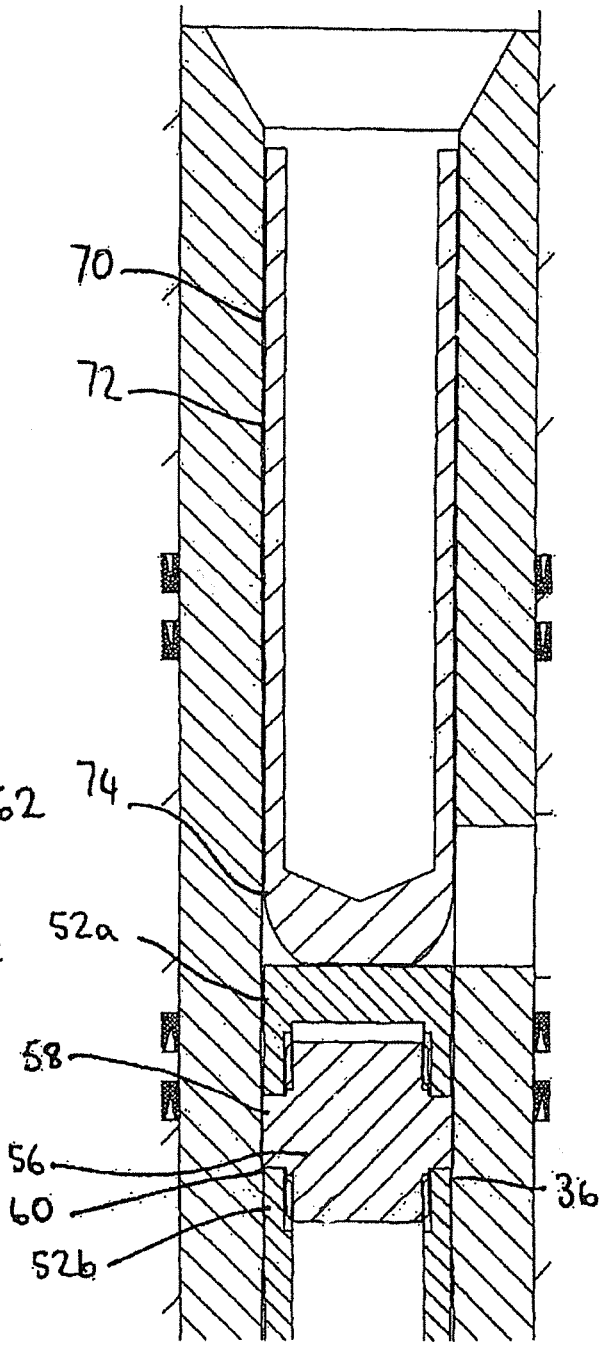
FIG. 5 is an enlarged view of the release member of the tool of FIG. 3.

The illustrated release device 70, more clearly illustrated in FIG. 5, has a hollow bullet-like form, with a cylindrical body 72 and a rounded leading end 74. The device 70 is dimensioned to have an external diameter only slightly smaller than the internal diameter of the sleeve 30, and is small enough the pass through the sleeve activation seat 36. Thus, as the release device 70 almost fully blocks the sleeve bore, and closes the ports 28, 32, any fluid pressure from above will create a pressure force across the device 70 and apply a significant mechanical force to the sleeve 30.

A sufficient fluid pressure above the release device 70 will apply an axial force of sufficient magnitude to extrude the relatively soft activation profile 60 through the hardened activation seat 36. It will be observed that the configuration of the latch arrangement 44, 62 is such that the latch provides no resistance to downward movement of the activating device 50 relative to the sleeve 30, and so once the profile 60 has been extruded through the seat 36 the activating device 50, and the release device 70, pass freely downwards and out of the sleeve 30, and into a catcher provided in the string below the tool 20.

The sleeve 30 is now free to return, under the influence of the spring 31, to the closed position, as illustrated in FIG. 1. The tool 20 will remain closed until a further activating device 50 is landed in the tool 20.

Reference is now made to FIG. 6 of the drawings, which is a sectional view of a bypass tool 20 including an alternative form of activating device 80. The tool 20 is illustrated in the open position in FIG. 6.

The upper end of the activating device 80, as shown in greater detail in FIG. 9 of the drawings, has an activating profile 82 defined by four dogs 84 held in an extended position by a central support shaft 86 having a tapered stepped dog-support surface 88. The dogs 84 are of a high strength material and extend through windows 90 in the activating device body 92. A flexible external seal 94 is mounted on the body 92 above the dogs 84.

The support shaft 86 is retained in the support position illustrated in FIGS. 6 and 9 by a pair of shear pins 96 which extend between the shaft 86 and the body 92 and are held in position by grub screws 97. The support shaft 86 includes a relatively small cross section upper portion 98 which extends through a central opening 100 in the activating device body 92, provided with a seal 102, such that the upper end of the portion 98 protrudes above the activating device body 92 like a button. The button-like portion 98 is the only part of the support shaft 86 exposed to the fluid pressure acting above the activating device 80, such that the fluid pressure force acting directly on the support shaft 86 tends to be relatively low.

The seals 94, 102 are primarily intended to prevent material and debris passing through the small gaps that are present between the activating device 80 and the sleeve bore and between the support shaft upper portion 98 and the activating device body 92.

Reference is now also made to FIG. 7 of the drawings, which shows the tool 20 of FIG. 6 in transition between the open and closed positions, and shows an alternative form of release device 110 having landed in the sleeve 30. Reference is also made to FIGS. 10 of the drawings, an enlarged view of the upper end portion of the activating device 80 and release device 110, and FIG. 11 of the drawings, an enlarged view of the upper end portion of the activating device 80.

The release device 110 is provided with a stack of chevron seals 112 dimensioned to provide a sliding sealing contact with the sleeve bore wall, and with sufficient flexibility to permit the device 110 to pass through the activation seat 36.

When the release device 110 lands in the sleeve 30 and the pressure in the fluid above the tool 20 is increased (which may occur without operator intervention due to the inertia of the fluid being pumped into the string behind the device 110), a pressure force acts on the release device 110 over the area of the interior passage of the sleeve 30. The release device 110 applies an equivalent and substantial mechanical force to the support shaft upper portion 98, which extends proud above the upper end of the activating device body 92. This causes the pins 96 to shear and the support shaft 86 moves downwards and lands on end stops 114. The steps 88 on the support shaft 86 no longer support the dogs 84 such that the dogs 84 may collapse inwards. In the absence of support, the activating device 80 travels downwards out of the sleeve 30, which may then return to the closed position, as illustrated in FIG. 1.

Reference is now also made to FIG. 8 of the drawings, which is a sectional view of a catcher sub 120 after receiving the activating device 80 and release device 110. The sub 120 is provided below the tool 20 and is configured such that fluid may flow past the caught devices 80, 110. In other embodiments a longer sub may be provided which is capable of accommodating two or more sets of devices 80, 110.

Figure 6A:
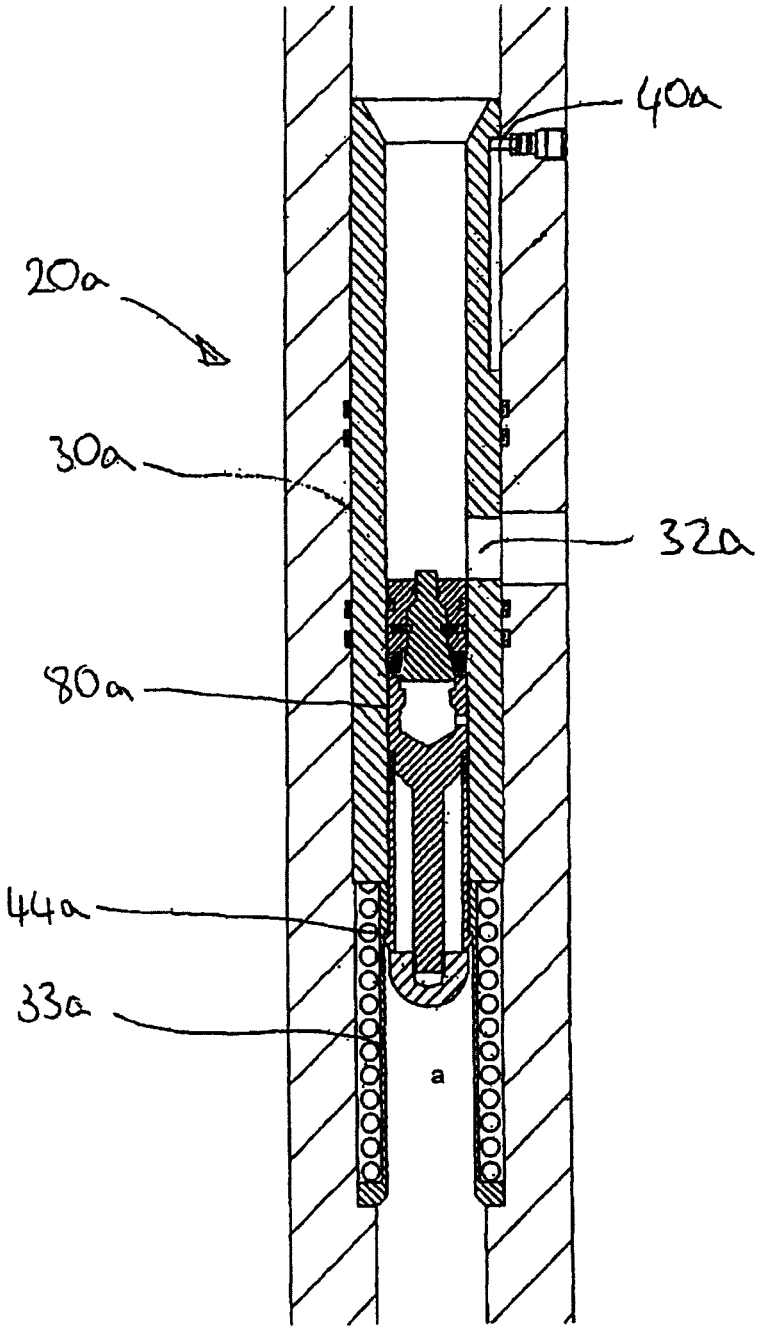

Reference is now made to FIG. 6*a* of the drawings, which is a sectional view of a bypass tool 20*a* including an alternative form of sleeve 30*a* and activating device 80*a*. The operation of the 20*a* is similar to that of the tool 20 as described above with reference to FIGS. 6 to 11. The tool 20*a* is illustrated in the open position in FIG. 6*a*.

In this tool 20*a* the sleeve 30*a* is considerably shorter, due to the provision of a static body-mounted spring housing 33*a*. This contrasts with the tool 20 described above, in which the spring housing 33 is formed by the lower end of the sleeve 30.

The upper end of the spring housing 33*a* also defines the body catch 44*a*, rather than the catch being defined by the body 22. In this embodiment the alignment pin 40*a* is located above the sleeve port 32*a*.

This arrangement allows provision of a relatively short activating device 80*a*, which is more convenient for handling, transport and storage. Furthermore, the catcher sub associated with the tool 20*a* may be considerably shorter than the sub 120 illustrated in FIG. 8, or the sub may accommodate a number of sleeves 30*a*, allowing the tool 20*a* to be cycled on more than one occasion.

Reference is now made to FIGS. 12, 13 and 14 of the drawings, sectional views of alternative forms of activating device in accordance with embodiments of the present invention.

The activating device 130 of FIG. 12 is intended to provide split flow when the tool 20 is open, that is a proportion of flow may continue through the tool 20 to, for example, cool the drill bit on the distal end of the string, and more particularly the stabilisers mounted on the BHA. The activation profile 131 is provided by an extrusion ring 132 of plastics or aluminium mounted between two threaded device body parts 133*a*, 133*b*. The latch part 134 on the device 130 is provided by a split ring 135 with four barb profiles, thus having a longer range of engagement than the single barb collet fingers 62 as described above. If used in conjunction with a body catch 44 as described above, the multiple barbs allow the latch 134, 44 to engage more readily and would still permit the latch 134, 44 to engage if, for example, a piece of debris was trapped between the activation profile 131 and the activation seat 36 and prevented the activating device 130 from fully extending through the sleeve 30.

The activating device 130 defines an axial through passage 136. An erodable aluminium nozzle 138 initially restricts the upper end of the passage 136. The nozzle 138 creates a significant pressure drop in fluid flowing through the passage 136 such that it is still possible for the device 130 to be used to generate a pressure differential sufficient to compress the sleeve spring 31 fully and engage the latch 134, 44. As flow through the passage 136 continues, the nozzle 138 erodes such that a greater proportion of flow through the string is directed to the bit. The pressure differential across the activating device 130 and the sleeve 30 will fall as the nozzle 138 erodes, however the engaged latch 134, 44 retains the sleeve 30 in the open position. The sleeve 30 will remain open until the operator drops an appropriate release device into the string to land on the activating device 130 and force the extrusion ring 132 through the hardened seat 36, and the latch 133, 44 is disengaged.

Reference is now made to FIG. 13, which illustrates an alternative form of activating device 150, although the latch part 151 comprises barbed collet fingers similar to the activating devices 50, 80 described above. The device body 152 includes a set of wiper dart cups 154 of three different diameters to suit the different sizes of pipe internal diameter the device 150 would encounter between surface and landing in the tool 20.

A nylon ball 158 screwed onto the upper end of the device body 152 provides the activation profile 156. The use of a ball 158 rather than a cylindrical extrusion member requires a larger degree of interference between the ball 158 and the activation seat, such that the seat provided for use in combination with this device 150 is likely to be of smaller diameter than the seat 36 illustrated in the figures. The release device is in the form of a smaller steel ball 160 which is dropped into the string and closes the sleeve side port, allowing pressure to build up above the device 150 and force the ball 158 through the seat.

FIG. 14 illustrates an activating device 170 defining a through passage 172. The device body 174 includes a set of rubber wiper dart cups 176 mounted on a metal tube 178. A nozzle 179 of relatively soft erodable material is provided at the upper end of the tube 178. The latch part 180 is provided by a rigid nose 182 defining four barbs, requiring provision of a flexible body catch, as will be described subsequently.

The activating profile 184 at the upper end of the device 170 is formed by a spring collet 186 with a very small square shoulder 188 configured to mate with a corresponding small shouldered activating seat. The upper end of the collet 186 is frustoconical and of reduced diameter and extends above the shoulder 188.

The lower end of a release device 190 is shown just above the device 170, and just before landing on the device 170. The release device 190 has an open lower end 192 defining a frustoconical surface. As the release device lower end 192 engages the upper end of the collet 186, the individual collet fingers are drawn radially inwards, such that the diameter described by the shoulder 188 decreases and the shoulder 188 disengages from the activation seat, allowing the activating device 170 to travel down through the sleeve.

Reference is now made to FIGS. 15, 16 and 17 of the drawings, sectional views of the latch part 180 of the activating device 170 of FIG. 14 in combination with alternative latch parts provided on the body of a tool in accordance with embodiments of the present invention. In FIG. 15, the body latch part comprises a double barbed collet 200. FIG. 16 show a body latch part comprising a double barbed spring split ring 202. Finally, FIG. 17 shows a body latch comprising four double barbed dogs 204, each of the dogs 204 being energised by a spring 206 held in place by a grub screw 208.

Reference is now made to FIG. 18 of the drawings, which is a sectional view of a further alternative form of activating device 220 which differs from the various activating devices described above in that this device 220 is not intended to latch the sleeve 230 in the open position. Rather, the device 220 is latched within the sleeve 230, but the sleeve 230 remains free to move upwards when there is no flow through the string.

The device 220 has a relatively short two-part body 222*a*, 222*b*. The activation profile 224 is defined by a split ring 226, initially maintained in an extended position by a central support shaft 228. The shaft 228 is held relative to the upper body part 222*a* by shear pins 232. The lower end of the shaft 228 is threaded and engages the lower body part 222*b*. A cap 234 is provided on the uppermost portion of the shaft 228 forming the button extending above the activating device body.

The activating device latch part 240 comprises a barbed collet 242 configured to engage with a catch 244 formed in the sleeve 230, directly below the activation seat 246.

In use, the activating device 220 is pumped into the string and lands on the sleeve 230 in a similar manner to the activating devices described above. The activation profile 224 engages the activation seat 246, occluding the sleeve bore. Also, the collet 242 on the device 220 engages the catch 244 on the sleeve 230.

Fluid pressure thus may act on the sleeve 230 and activating device 220 and move the sleeve 230 downwards in the body 260 to align the ports 262, 264, as illustrated in FIG. 18. An LCM pill could then be pumped down the string and into the annulus. However, if flow through the string stops, the sleeve 230 will move upwards, under the influence of the spring 266, to close the port 264. If, for example, the string was then raised in the bore to lift the string above the LCM pill, any tendency for U-tubing would be resisted: the port 264 is closed and, as the device 220 is latched in the sleeve 230, fluid cannot reverse circulate up through the valve. In the absence of the latch arrangement it would take minimal reverse flow pressure to lift the activating device 220 out of the sleeve 230 and allow LCM into the lower BHA.

To release the device 220, and reinstate flow to the lower part of the BHA, a release device, as described above, is pumped into the string and lands on the cap 234, pushing the shaft 228, with the lower body part 222*b*, downwards to remove support from the split ring 226. The split ring 226 may then radially contract out of engagement with the seat 246 and the device 220 then passes through the sleeve 230, and into a catcher sub 120 provided below the valve.

The device 220 offers the advantage that a larger number of the relatively short devices 220 may be accommodated in the catcher sub 120, allowing the valve to be cycled more often without requiring retrieval of the string from the bore. Alternatively, a shorter catcher sub may be provided.

FIG. 19 of the drawings illustrates an activating device 280 intended to provide the possibility of split flow in a bypass tool, the device 280 being illustrated after landing in a sleeve 282 and moving the sleeve 282 to the open position, such that the sleeve ports 284 are aligned with body ports 286. In this configuration a proportion of the fluid pumped down through the string from surface may pass directly from the string bore and into the annulus without passing through the BHA. However, as the device 280 defines a through passage, a proportion of flow also continues to flow through the BHA.

The device 280 features a relatively short body 288 and the activation profile 290 is defined by a split ring 292 located between two upper body parts 288*a*, 288*b* and initially maintained in an extended position by an annular central support 294. The support 294 is held in place relative to the upper body part 288*a* by shear pins 296 and the lower end of the support 294 is threaded to the lower body part 288*b*. The support 294 extends above the activating device body 288 and is thus available to be engaged by an appropriate release device, as will be described. An external retaining ring 298 is mounted on the upper end of the support 294 to prevent the released support 294 passing completely through the upper body part 288*a*, and ensuring that the body parts 288*a*, 288*b* remain coupled together.

The upper end of the support 294 is further provided with a flow restriction 300 defining a nozzle which serves to control the pressure drop across the activating device 280 while fluid is being pumped through the string. The restriction 300 is formed of a suitable erosion resistant material. Also, a sleeve 301 of an erosion resistant material, such as a ceramic, is used to line the throughbore 302 that extends through the device 280.

The activating device latch part 304 comprises a barbed collet 306 configured to engage with a catch 308 formed in the sleeve 282, below the activation seat 310. The collet 306 is mounted in the lower body part 288*b* and is retained on the body part 288*b* by a threaded nose 312. The collet fingers 314 are sandwiched between an external sleeve 320 and by a resilient internal sleeve 318. The sleeves 320, 318 support and protect the collet fingers 314 as the device 280 is being pumped down through the string.

In use, the activating device 280 is pumped into the string and lands on the sleeve 282 in a similar manner to the activating devices described above. The activation profile 290 engages the activation seat 310, restricting fluid passage through the sleeve bore. Also, the collet 306 on the device 280 engages the catch 308 on the sleeve 282.

If fluid is pumped down through the string, the flow restriction 300 creates a pressure differential across the device 280, and thus also across the sleeve 282. This pressure differential acts across the cross-sectional area of the sleeve 282 and moves the sleeve 282 downwards, against the action of the compression spring 315, to align the sleeve and body ports 284, 286, as illustrated in FIG. 19.

Once the ports 284, 286 are aligned, the pressure differential across the device 280 will likely fall, as a proportion of the fluid flowing down through the string may pass through the ports 284, 286 and into the surrounding annulus. The flow through the ports 284, 286 is controlled, as least in part, by a flow restriction 316 located in the body port 286, and also by the flow restriction 300 provided in the device 280. The division of flow sought by an operator may vary, depending on the downhole operation. For example, for a hole cleaning operation it may be desired that a majority of the flow, perhaps 90 to 95%, passes directly into the annulus through the side ports 284, 286, while a smaller proportion, perhaps 5 to 10%, passes through the device 280, through the BHA, and then up the annulus around the BHA. The fluid passing through and around the BHA primarily serves to cool the larger diameter parts of the BHA which may be in contact with the bore wall as the BHA rotates, and also serves to prevent cuttings settling in the annulus around the BHA. On the other hand, if drilling is to continue with the device 280 in place, a 50/50 split of flow may be sought.

The applicant has recognised that efficient use and operation of the bypass tool requires careful selection of the flow restrictions 300, 316, and matching of the flow restrictions 300, 316 to other elements of the string, such as the pressure drop experienced by the fluid flowing through the BHA, as described below.

For a 100% bypass situation, for example utilising the device 220 illustrated in FIG. 18, where all of the flow would be through the side ports 284, 286, the restriction 316 may be sized to provide a pressure drop equal to the force generated by the spring 315: the fluid below the activating device and the fluid in the annulus below the ports 284, 286 is static such that the pressure of the fluid below the activating device 280 is substantially the same as the pressure in the annulus outside the ports 284, 286. If the restriction 316 was tighter, and produced a greater pressure drop, this would serve no useful purpose, restricting the available flow rate, increasing pressure losses and reducing the cleaning capabilities of the circulating fluid. On the other hand, a larger restriction 316 might result in fluttering of the sleeve 282, if the pressure force necessary to overcome the spring 315 is only achievable when the ports 284, 286 are partially misaligned. This creates undesirable vibration and wear, the possibility of premature seal failure and an increased likelihood of erosion damage to the ports 284, 286. As described, the situation is further complicated in a split flow situation.

For split flow, the downward force acting on the sleeve 282 is a function of the pressure drop across the restriction 300 and the effective piston area, this being the cross-sectional area of the sleeve 282. The pressure drop across the restriction 300 is related to the flow rate and the size of the restriction 300. However, the pressure drop experienced by the fluid flowing through the BHA must also be accounted for, such as the pressure drop in the fluid flowing through the jetting nozzles in the BHA. Furthermore, the desired relative division of flow between the side ports 284, 286 and through and around the BHA may differ, depending on the operation. A very tight restriction 300 will tend to produce a significant pressure drop, however if the restriction 300 is too tight, and for example does not take account of the additional pressure drop when the fluid passes through the nozzles in the BHA, all of the flow will be directed through the side ports 284, 286. However, a larger restriction 300, providing less resistance to flow through the device 280, and a smaller force acting on the device 280 and sleeve 282, may result in sleeve flutter, with the associated vibration and wear.

In use, the activating device 280 is pumped into the string and lands on the sleeve 282 in a similar manner to the activating devices described above. The activation profile 290 engages the activation seat 310, partially occluding the sleeve bore. Also, the collet 306 on the device 280 engages the sleeve catch 308.

Fluid pressure thus may act on the sleeve 282 and activating device 280 and move the sleeve 282 downwards in the tool body to align the ports 284, 286, as illustrated in FIG. 19. The flow of fluid down through the string is now split between continuing down through the tool body and the BHA, and passing directly into the annulus surrounding the tool body via the ports 284, 286. The erosion resistant liner 301 prevents the flow through the device 280 from eroding and damaging the device 280, and maintains the flow characteristics of the device 280 substantially constant. However, if flow through the string stops, the sleeve 280 will move upwards, under the influence of the spring 315, to close the port 286.

To release the device 280, and reinstate full flow to the lower part of the BHA, a release device, as described above, is pumped into the string and lands on the protruding upper end of the support 294, shearing the pins 296 and pushing the support 294 and the lower body part 288*b* downwards to remove support from the split ring 292. The split ring 292 may then radially contract out of engagement with the seat 310 and the device 280 then passes through the sleeve 282, and into a catcher sub provided below the valve.

Reference is now made to FIG. 20 of the drawings, which illustrates an activating device 330 in accordance with an alternative embodiment of the present invention. The activating device 330 may be used in combination with a bypass tool, or may be used in other applications. In the Figure the device 330 is shown after landing is a fixed sleeve 332 located in a downhole tubular 334.

The device 330 shares a number of features with the device 220 described above with reference to FIG. 18. In particular, the activating profile 336 is defined by a split ring 338 mounted in a two-part body 340 and is initially maintained in an extended position by a central support shaft 342. The shaft 342 is held relative to the upper body part 340*a* by bronze or brass shear pins 344. The lower end of the shaft 342 is threaded and engages the lower body part 340*b*, which also forms a rounded nose 346 at the leading end of the device 330.

A closing sleeve 348 has a seal-carrying part 350 and a threaded lower end 352 which extends through the upper body part 340*a* and engages the shaft 342, leaving a space 354 between the part 350 and the body 340. The sleeve 348 features three independent seals 356 sized to form a sealing fit with the internal diameter of the fixed sleeve 332, and thus the seals 356 describe a larger diameter than the profile 336. The provision of the three seals minimises the risk of failure, providing two back-up seals. If desired, a sleeve 332 having a longer bore may be provided such that an emergency disconnect sleeve with further seals may be landed on top of the part 350 in the event of total seal failure.

The sleeve 332 defines an activation seat 360 formed by the upper inner edge of a press-fitted ring 362 of suitable material, ideally a material that is hard and likely to resist erosion, corrosion resistant, and capable of being formed or machined smooth. Appropriate materials include tungsten carbide, a ceramic, or a high specification alloy, such an austenitic nickel-chromium-based superalloy, for example the alloy sold under the Inconel trade mark by Special Metals Corporation. The ring 362 is intended to be readily replaceable.

In common with the other embodiments, the activation seat 360 has a very small radial extent, in this example the seat 360 extending only 0.445 mm from the wall of the sleeve 332. This also minimizes the radial extent of the seals 356 (the sleeve 348 must be able to pass through the seat 360). If desired, the radial extent of the seat 360 may be as small as 0.254 mm, or as much as 1.6 mm.

The mating faces of the activating profile 336 and the activation seat 360 are angled at 45 degrees. This minimizes the friction that results from the split ring 338 being radially compressed and pushed into tighter contact with the shaft 342. At shallower angles the radial force and resulting friction can make it difficult to push the shaft 342 down through the split ring 338 and de-support the ring 338. The friction between the shaft 342 and ring 338 may also be reduced by provision of appropriate materials, surface finishes and coatings, and by filling the small voids within the body 340 with grease. The grease of course reduces friction and also assists in prevention of ingress of drilling mud and other materials which could adversely affect relative movement of the contacting faces.

In use, the device 330 may be pumped into and though a string of tubing in a similar manner to the other devices described above. As the device 330 passes through the tubing the device 330 will serve to drift the tubing, that is establish the tubing is free from obstruction and will permit subsequent passage of a device of the same or smaller diameter. The device 330 will pass through the string until the activating profile 336 engages the activation seat 360. The seals 356 form a sealing contact with the sleeve 332 (there are no seals on the body 340), such that the device plugs the string.

Those of skill in the art will recognise that the device 330 will land in the sleeve with significant force, due to the momentum of the device 330 and the momentum and pressure of the fluid being pumped after the device 330. With this in mind, the device 330 is constructed to have a relatively low mass. Also, given that the device 330 is configured to be released from the seat 360 using elevated pressure, an operator should not seek to pump the device 330 at an elevated rate, to avoid the creation of pressure pulse on the device 330 landing on the seat 360 that might be sufficient to release the device 330. Furthermore, despite the relatively small overlap between the profile 336 and the seat 360, the device 330 is not extruded or forced past the seat 360.

Pressure may then be increased above the device 330. This pressure creates a downwards pressure force on the seal-carrying part 350. However, downwards movement of the part 350, and the attached shaft 342, relative to the seat-held-up split ring 338, is resisted by the shear pins 344. The relatively high pressure above the device 330 may be used for a variety of purposes, for example: to activate a pressure actuated or activated tool (for example a tool actuated by a differential pressure between the string bore and the annulus); or to pressure test a tubing string. Alternatively, the device 330 may simply serve as a plug, or may be used to drift the tubing.

Once the task or function has been completed, the device 330 may be moved from the sleeve 332, and flow through the string reinstated, as described below.

Increasing pressure above the device 330 sufficiently to shear the pins 344 causes the shaft 342 to move downwards and remove the radial support for the split ring 338, such that the ring 338 may radially contract and the profile 336 disengage from the seat 360. The small radial extent of the seat 360 facilitates disengagement of the profile 336 and seat 360 and also passage of the seals 356 through the seat 360. The provision of the space 354 between the seal-carrying part 350 and the body 340 minimizes the possibility of a solid object trapped between the parts 350, 340 preventing the required relative movement. The device 330 may then pass through the sleeve 332, and pass into an appropriate catcher, leaving uninhibited flow through the sleeve 332. If desired or necessary, one or more further devices 330 may be pumped into the sleeve and further functions or tasks carried out.

Those of skill in the art will recognise that the above-described embodiments are merely exemplary of the present invention and that various modifications and improvements may be made thereto without departing from the scope of the invention. For example, in the embodiment illustrated in FIG. 18, the activating device latch part 240 is positioned below the activation profile 224. In other embodiments, the activating device latch part may be provided above the activation profile, and the sleeve configured such that the sleeve catch is located above the activation seat. Furthermore, the various embodiments described above include a number of different features. It will be recognised by those of skill in the art that many of these features offer advantages independently of the other features present in the embodiments and could be incorporated in other aspects of the invention.

The invention claimed is:

1. A downhole bypass valve comprising:

a tubular body including a side port;

a sleeve axially movably mounted in the body and normally biased to a closed position to close the side port;

an activating device configured to be translatable into the body to engage the sleeve and permit movement of the sleeve to an open position and open the side port; and a latch having a part in the body and a part in the activating device, the parts of the latch configured to directly contact one another upon movement of the sleeve to the open position, wherein the parts of the latch are configured to engage and retain the sleeve in the open position, the activating device further being operable to disengage from and translate through the sleeve and the parts of the latch further being operable to disengage and permit the sleeve to return to the closed position.

2. The valve of claim 1, wherein the sleeve defines an internal activation seat of a first diameter and the activating device has an external activation profile defining an activation diameter larger than said first diameter and adapted to engage the activation seat to permit application of a fluid pressure opening force to the device and the sleeve to move the sleeve downwards to an open position and open the side port, the activating device further being operable to disengage the activation profile from the activation seat so that the activation device is translatable down through the sleeve.

3. The valve of claim 1, wherein the activation profile of the activating device is configurable to be maintained at a larger diameter than the activation seat to hold the device on the seat, and the profile is further re-configurable to radially retract.

4. The valve of claim 1, wherein the sleeve defines a port that is aligned with the side port when the sleeve is in the open position.

5. The valve of claim 1, wherein the latch includes a catch and wherein the activating device includes a latch member configured to engage the catch.

6. The valve of claim 5, wherein the catch has no moving parts.

7. The valve of claim 5, wherein the catch is configured to permit translation of the latch member relative to the catch in one direction and resist translation relative to the catch in the opposite direction.

8. The valve of claim 5, wherein the latch part on the activating device comprises at least one spring finger.

9. The valve of claim 8, wherein the spring finger is radially supported by a resilient member.

10. The valve of claim 9, wherein the resilient member comprises an elastomer sleeve.

11. A method of operating a downhole bypass valve having a tubular body including a side port and a sleeve mounted in the body and normally biased to close the port, the method comprising:

landing an activating device in the sleeve;

moving the sleeve to open the side port;

directly contacting a latch part in the body and a latch part in the activating device upon movement of the sleeve to the open position, wherein the parts of the sleeve retain the sleeve in the open position, passing fluid through the side port;

disengaging the activating device from the sleeve;

translating the activating device through the sleeve; and disengaging the parts of the latch, permitting the sleeve to return to the closed position.

12. The method of claim 11, further comprising:

landing the activating device in the valve such that an external activation profile provided on the sleeve engages an internal activation seat on the sleeve;

applying a fluid pressure opening force to the activating device and the sleeve to move the sleeve downwards and open the side port; and disengaging the activation profile from the activation seat.

13. The method of claim 12, comprising configuring the activation profile to maintain a larger diameter than the activation seat; retaining the device on the seat; and re-configuring the profile such that the profile radially retracts and the device passes through the seat.

14. The method of claim 12, comprising landing a further activating device in the valve and retaining said further activating device in the valve whereby the activation profile and seat remain engaged, and the parts of the latch remain engaged, such that the sleeve remains in the open position.

15. The method of claim 11, comprising dry tripping of a drill string including the valve.

16. The method of claim 11, comprising moving the sleeve to the open position only when the activating device lands in the sleeve, and retaining the sleeve in the open position only while the activating device is in place in the valve.

17. The method of claim 11, comprising maintaining the sleeve in the open position independently of fluid flow or pressure.

18. The method of claim 11, comprising permitting fluid to flow from an annulus around the valve into the valve via the side port.

19. The method of claim 11, comprising reverse circulating fluid from surface down an annulus and up through a string via the open side port.

20. The method of claim 11, comprising dropping the activating device into a string in which the valve is mounted to land in the sleeve without pumping fluid after the device.

* * * * *